US012000270B2

(12) United States Patent
Fox

(10) Patent No.: US 12,000,270 B2
(45) Date of Patent: Jun. 4, 2024

(54) TRANSMISSION LINE CYLINDRICAL CONNECTOR ASSEMBLY

(71) Applicant: Joe Fox, Spanish Fork, UT (US)

(72) Inventor: Joe Fox, Spanish Fork, UT (US)

( * ) Notice: Subject to any disclaimer, the term of this patent is extended or adjusted under 35 U.S.C. 154(b) by 100 days.

(21) Appl. No.: 17/955,708

(22) Filed: Sep. 29, 2022

(65) Prior Publication Data

US 2023/0022626 A1 Jan. 26, 2023

(51) Int. Cl.
*E21B 47/12* (2012.01)
*E21B 17/02* (2006.01)

(52) U.S. Cl.
CPC ..... *E21B 47/12* (2013.01); *E21B 17/028* (2013.01)

(58) Field of Classification Search
CPC ..... E21B 47/12; E21B 17/028; E21B 17/0283
See application file for complete search history.

(56) References Cited

U.S. PATENT DOCUMENTS

| | | | | |
|---|---|---|---|---|
| 6,536,519 | B1 * | 3/2003 | Vaynshteyn | E21B 47/12 73/152.59 |
| 6,844,498 | B2 * | 1/2005 | Hall | F16L 15/009 174/75 C |
| 9,391,417 | B2 * | 7/2016 | Zacharko | H01R 39/08 |
| 9,447,644 | B2 * | 9/2016 | Millet | E21B 17/026 |
| 2008/0311776 | A1 * | 12/2008 | Cox | E21B 47/00 166/313 |
| 2020/0190972 | A1 * | 6/2020 | Sauthoff | F16L 15/001 |

* cited by examiner

*Primary Examiner* — Nicole Coy

(57) ABSTRACT

A tool string electrical transmission line connector comprising a cylinder adapted for mounting within a bore adjacent to a shoulder within the bore of a downhole tool. The cylinder comprising an inside axial side wall spaced apart from an outside axial side wall joining top and bottom surfaces. The connector further comprises an axial channel open to the outside axial side wall intersecting the bottom surface and a housing open to the outside axial side wall. The housing being open to the top surface. An electrical transmission line connector is disposed within the housing. An electrical transmission line is disposed within the axial channel and connected within the housing to an adjacent electrical transmission device. The axial channel further comprises one or more tab closures. The tab closures may comprise a clamp. When fitted into the bore, the tabs close around a cable residing within the channel.

19 Claims, 28 Drawing Sheets

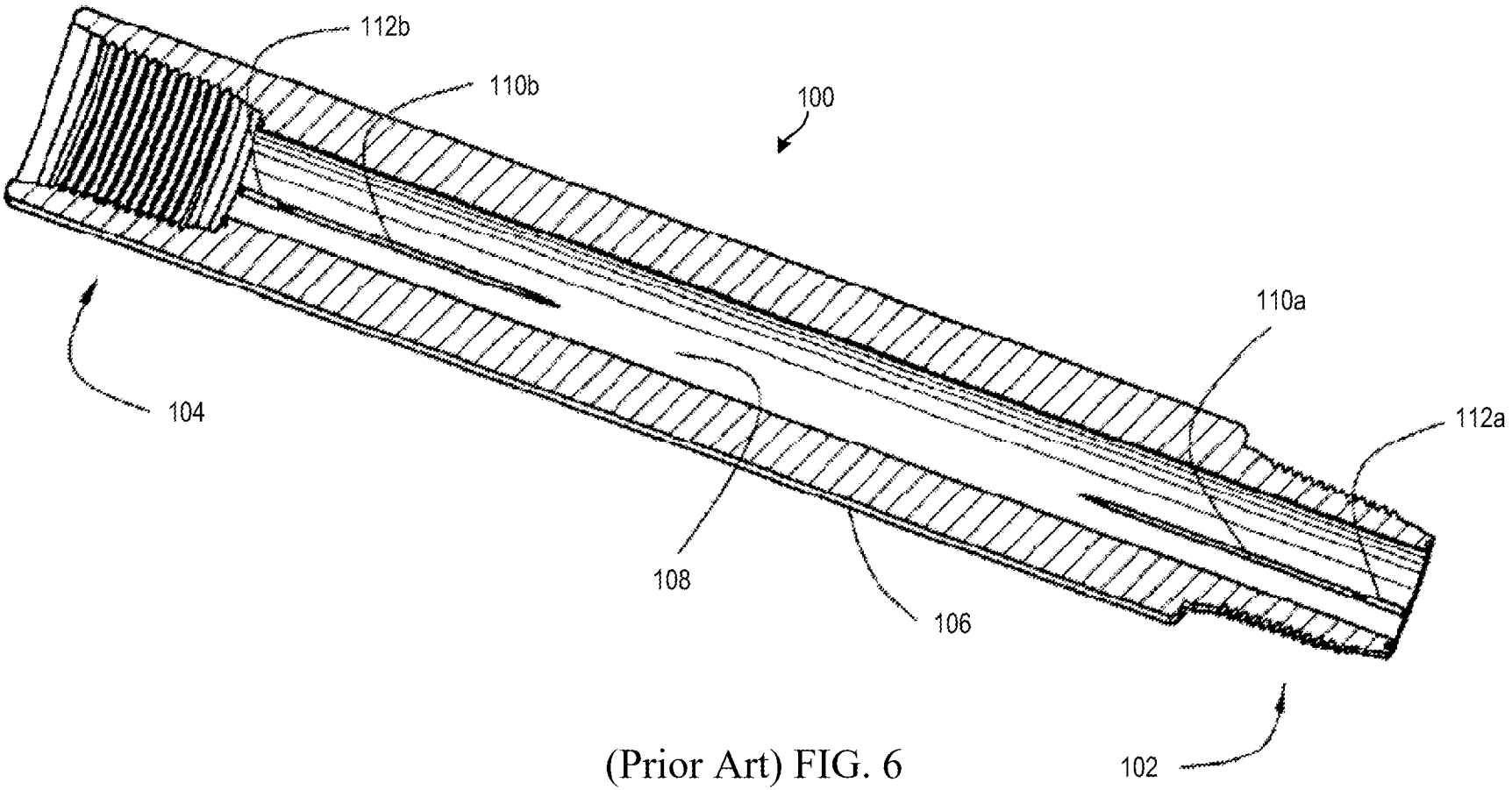
(Prior Art) FIG. 6

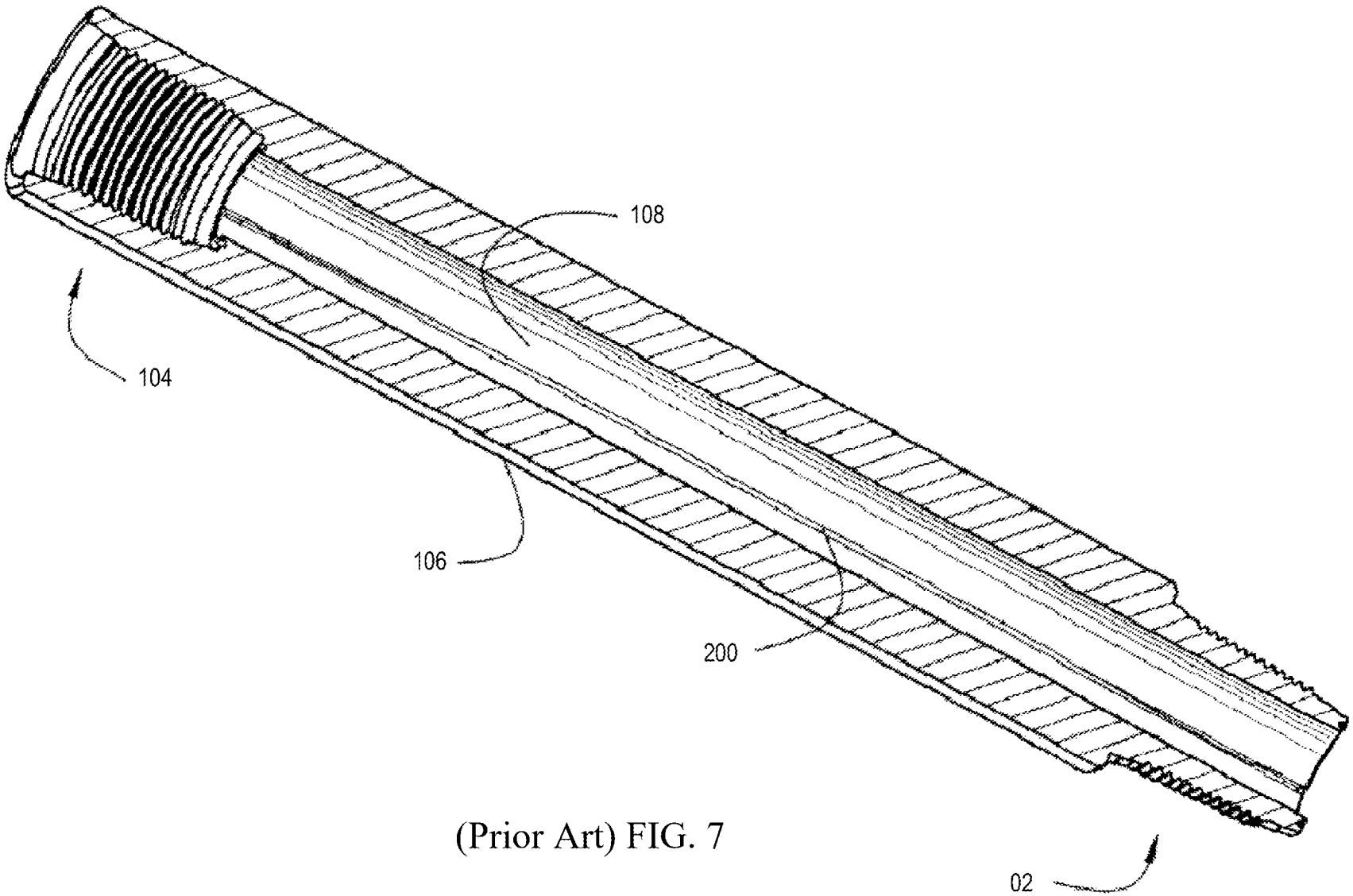
(Prior Art) FIG. 7

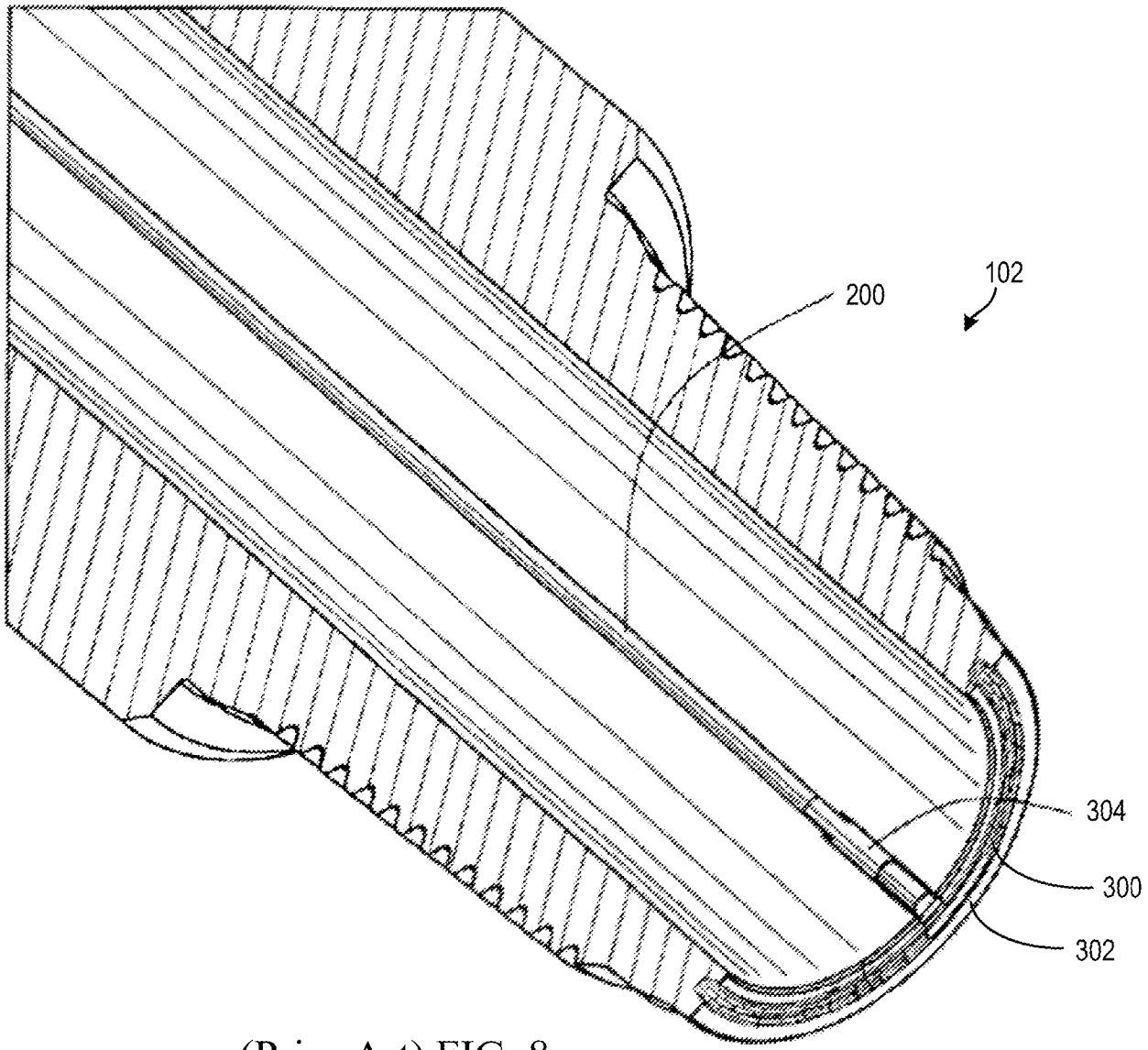
(Prior Art) FIG. 8

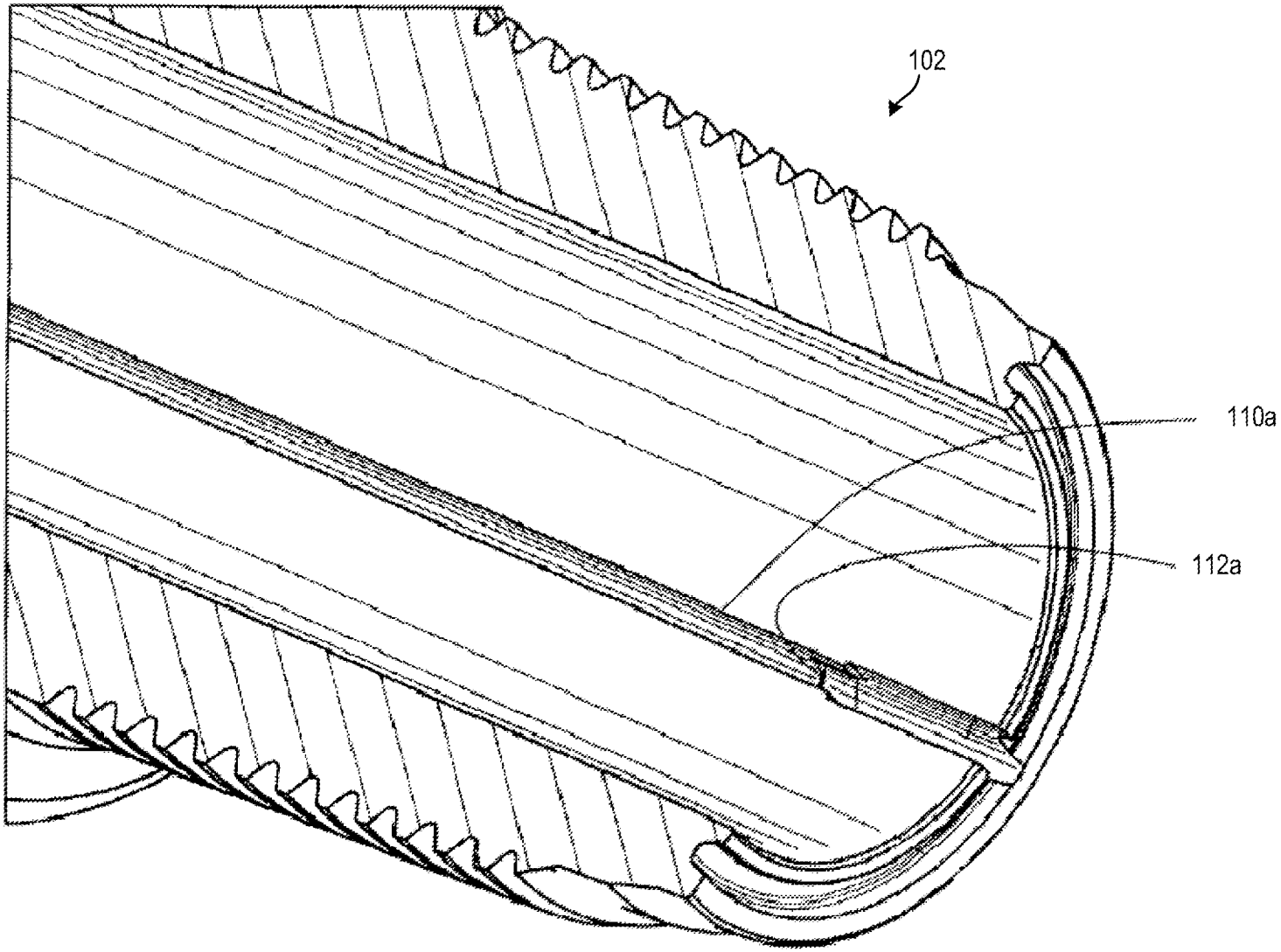
(Prior Art) FIG. 9

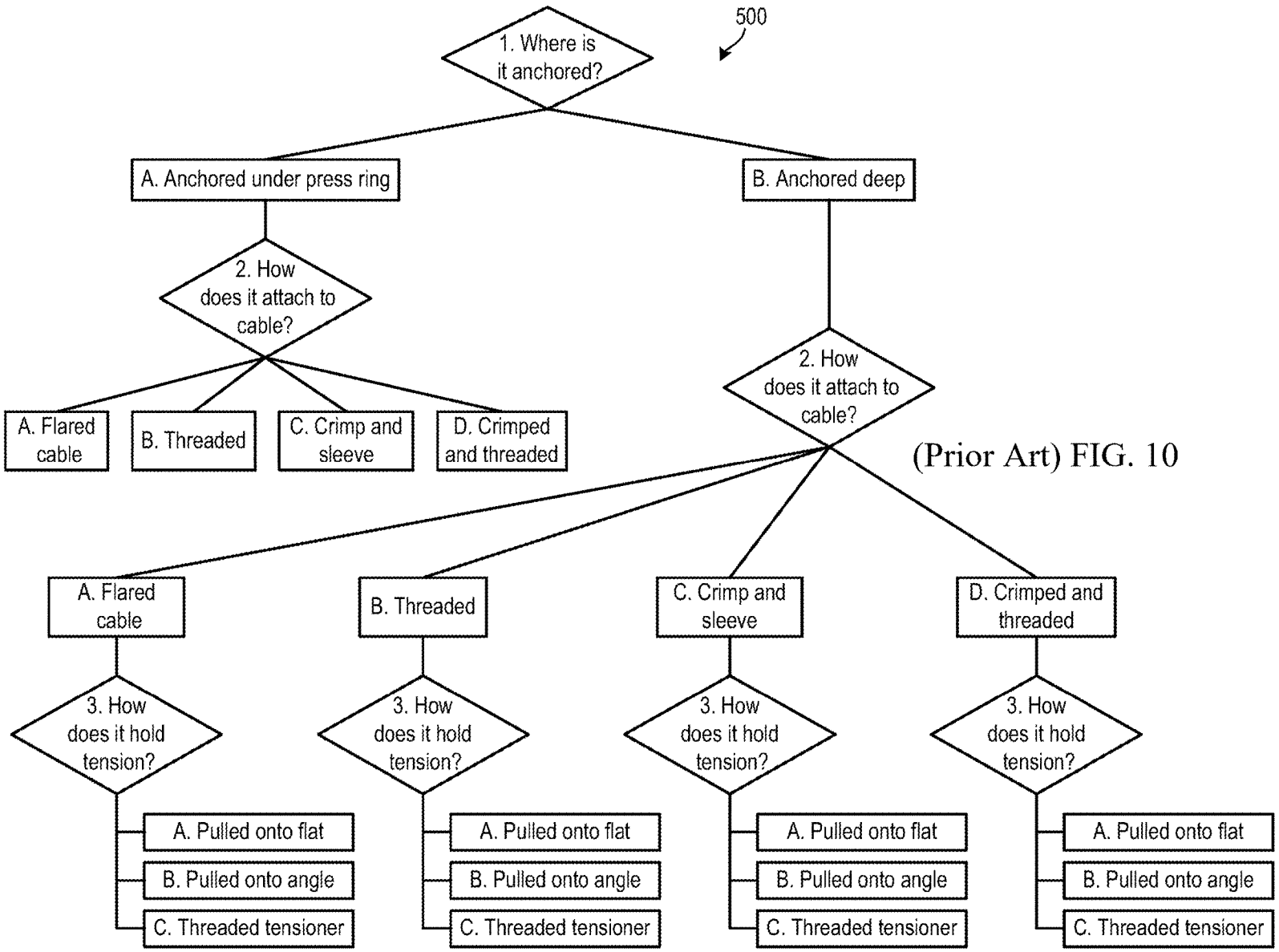
(Prior Art) FIG. 10

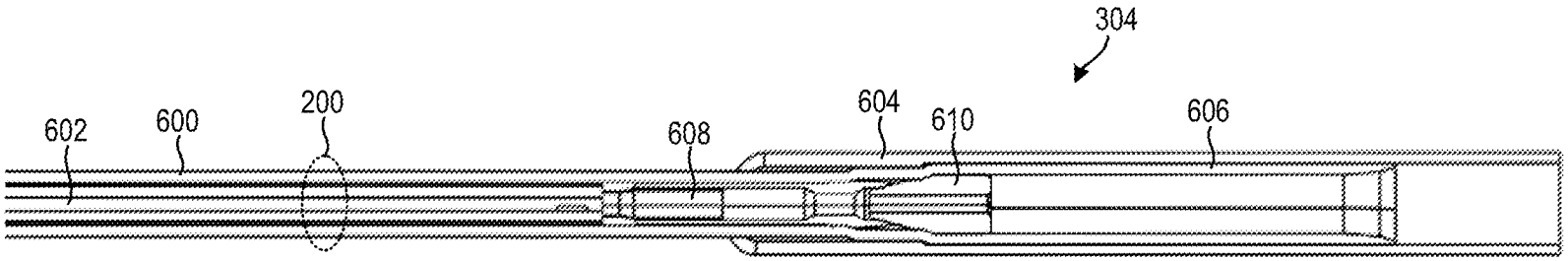
(Prior Art) FIG. 11A
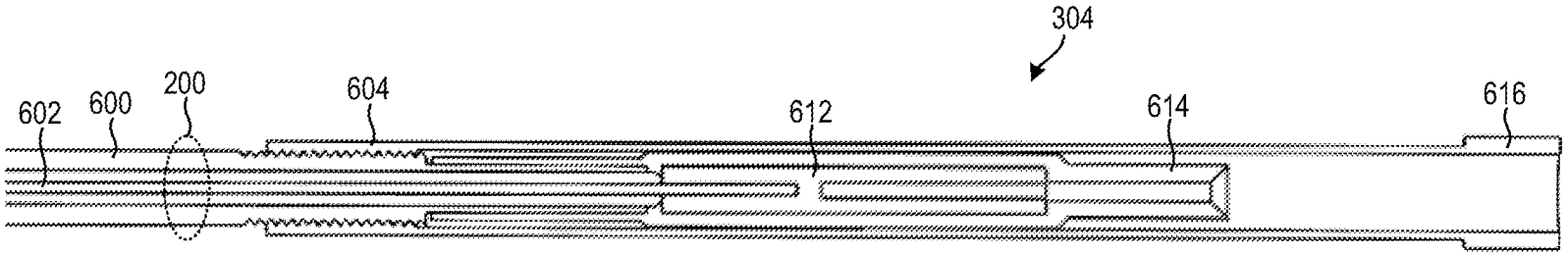
(Prior Art) FIG. 11B

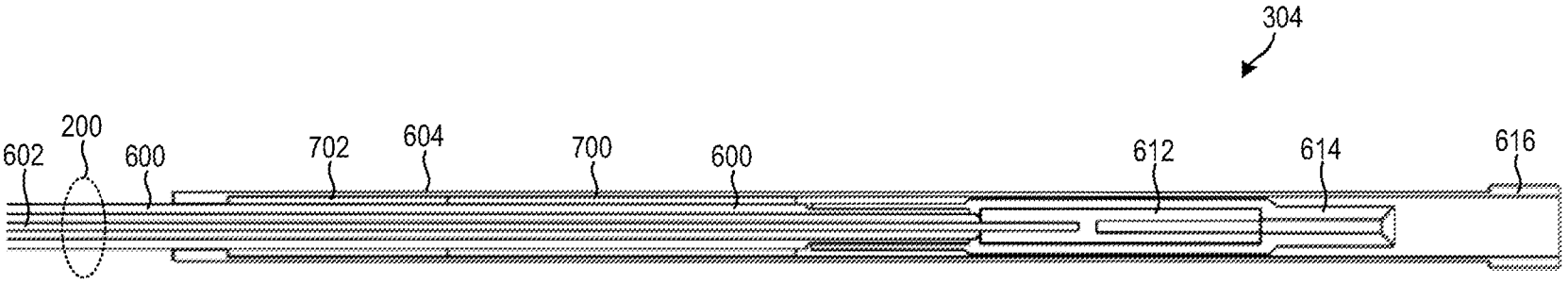
(Prior Art) FIG. 12A
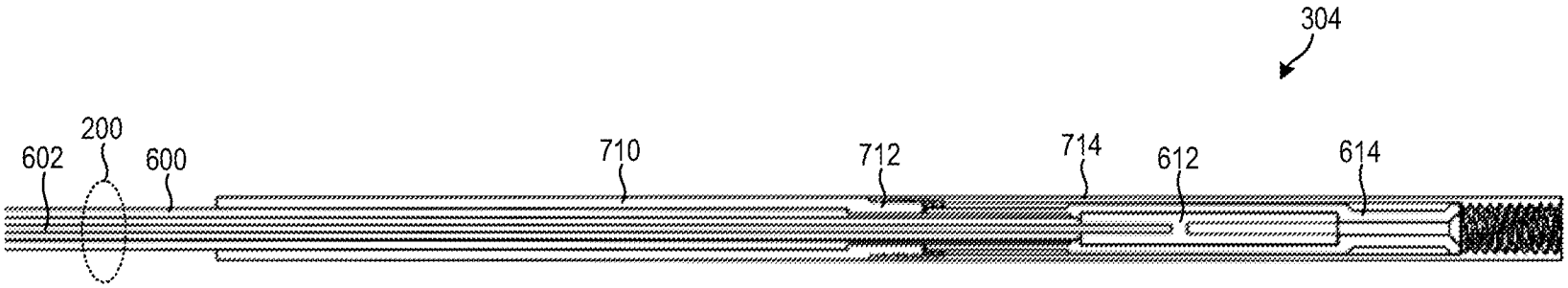
(Prior Art) FIG. 12B

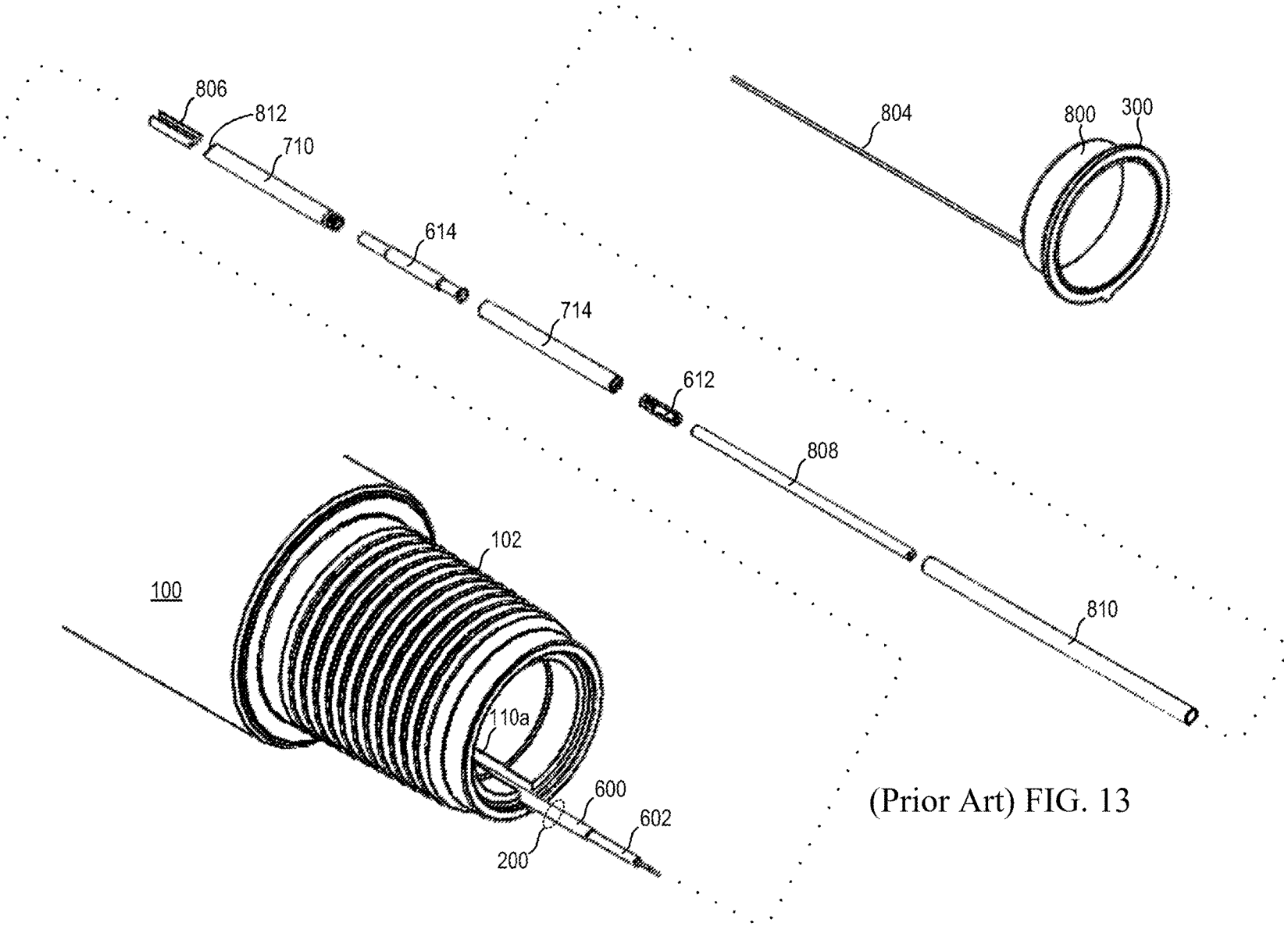
(Prior Art) FIG. 13

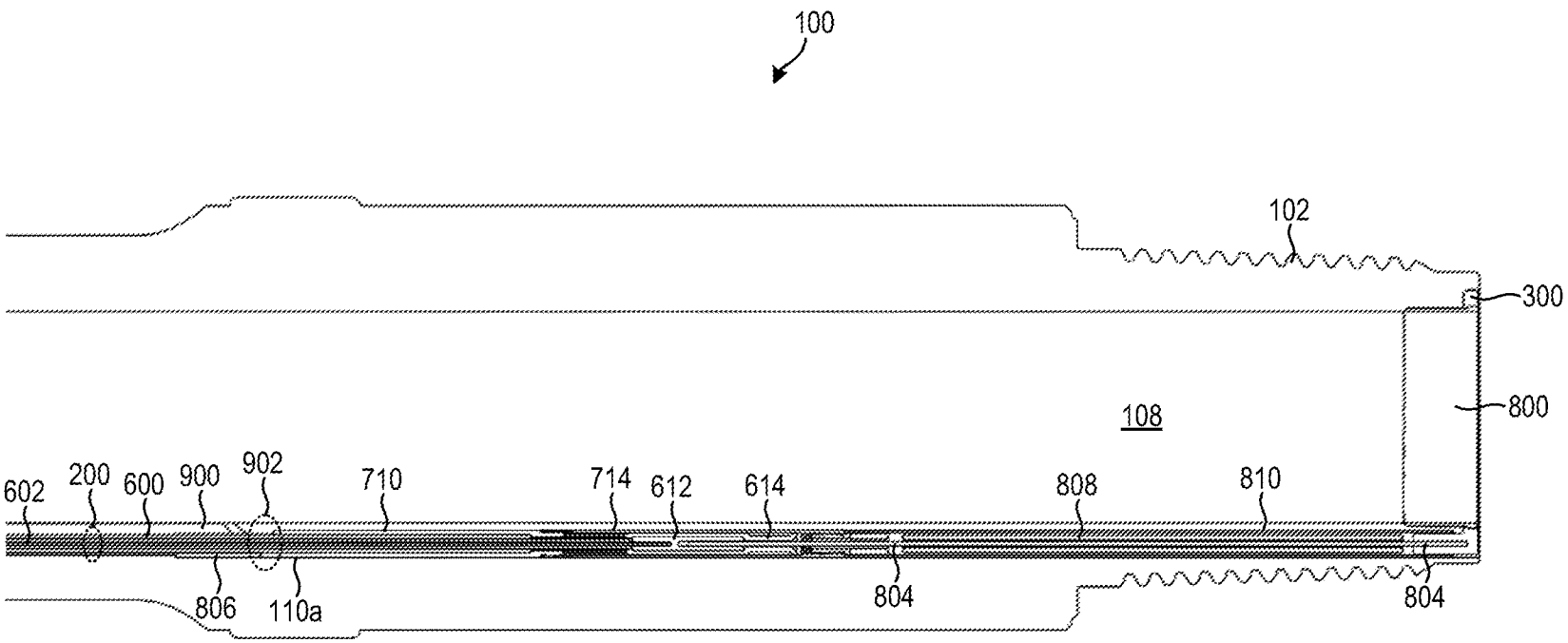
(Prior Art) FIG. 14

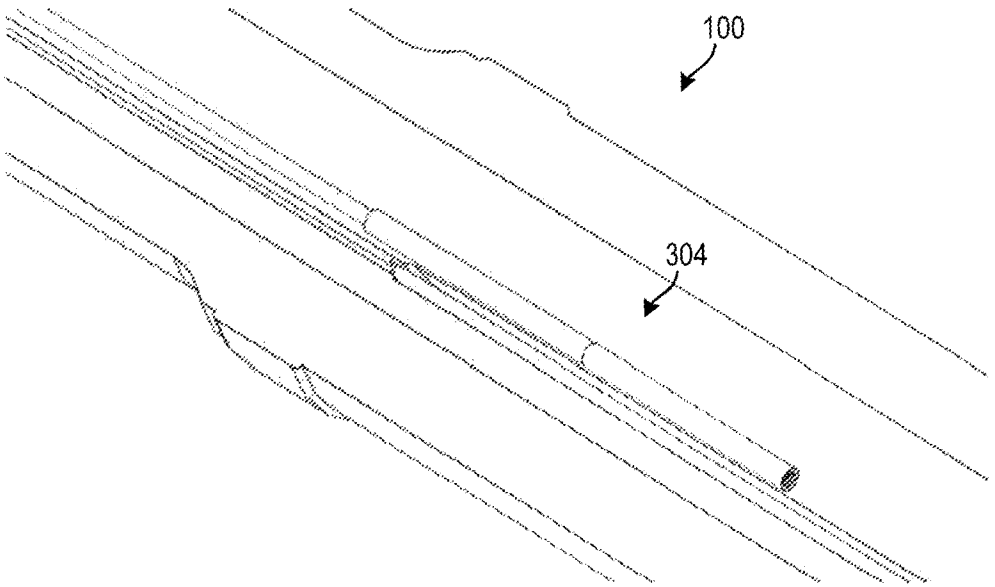
(Prior Art) FIG. 15A
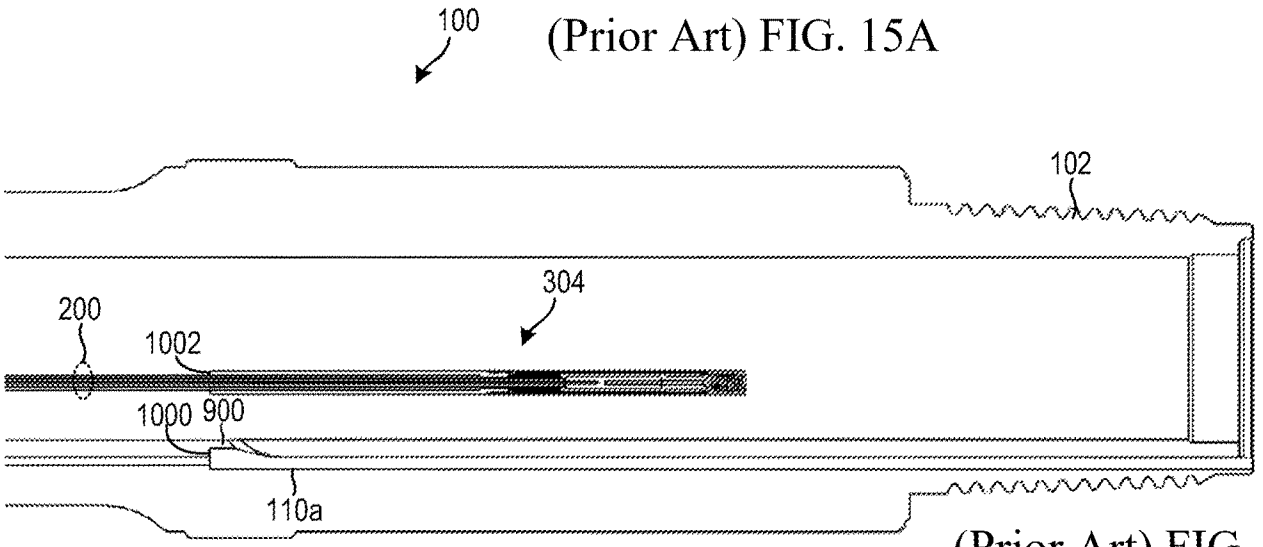
(Prior Art) FIG. 15B

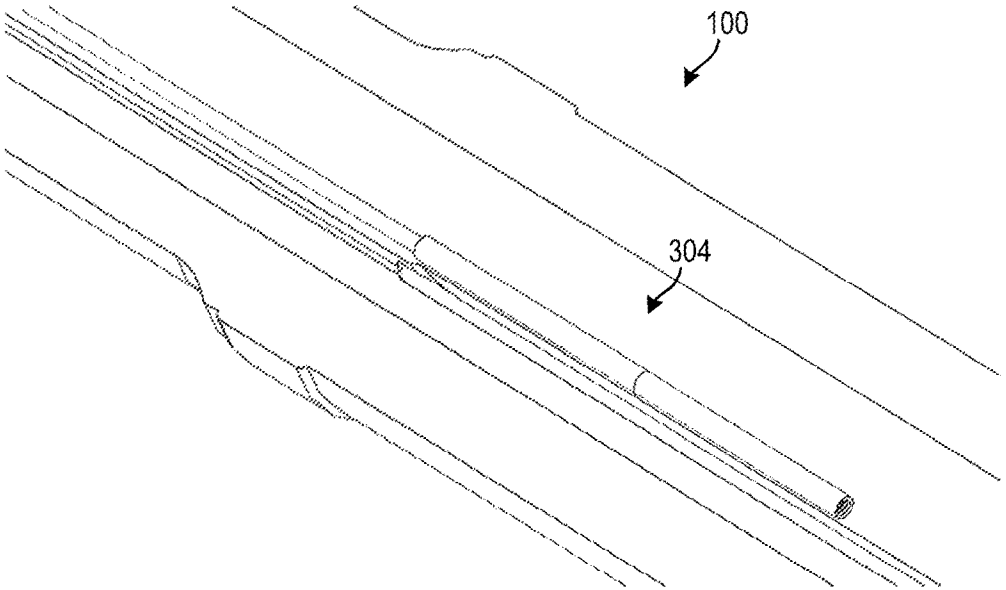
(Prior Art) FIG. 16A
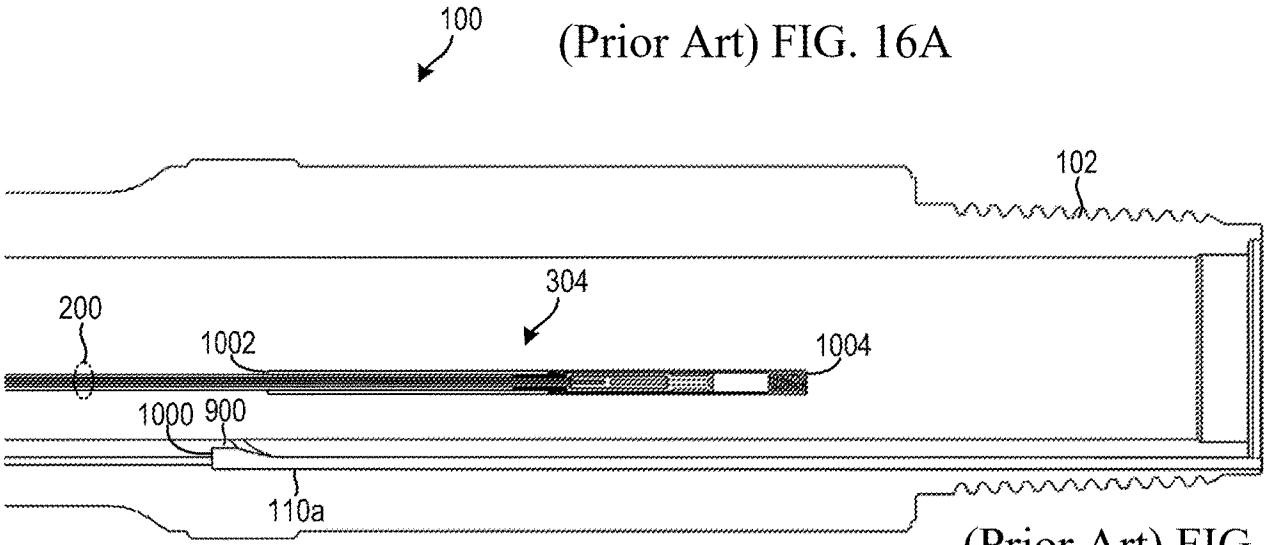
(Prior Art) FIG. 16B

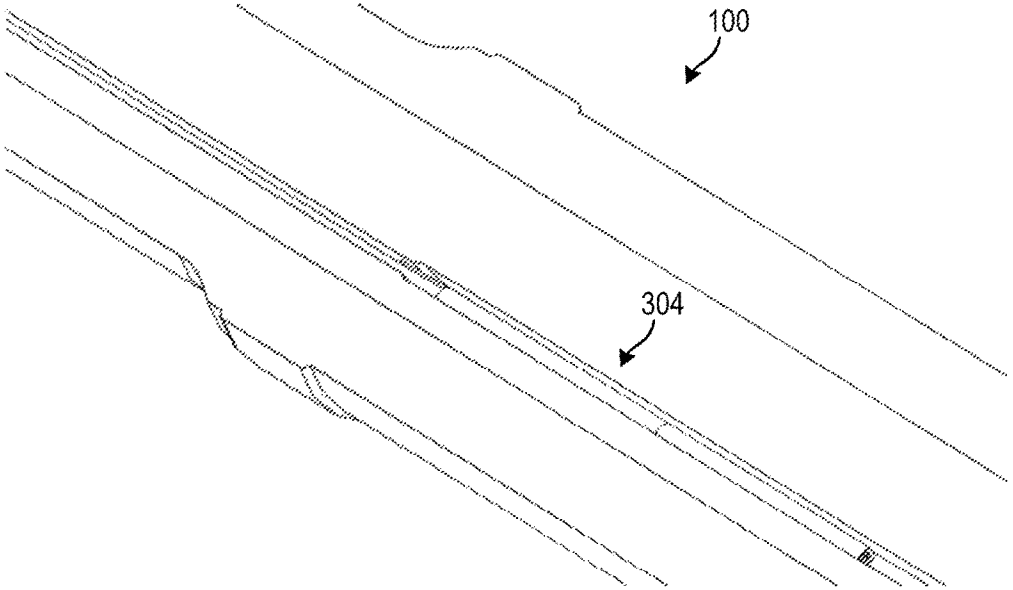
(Prior Art) FIG. 17A
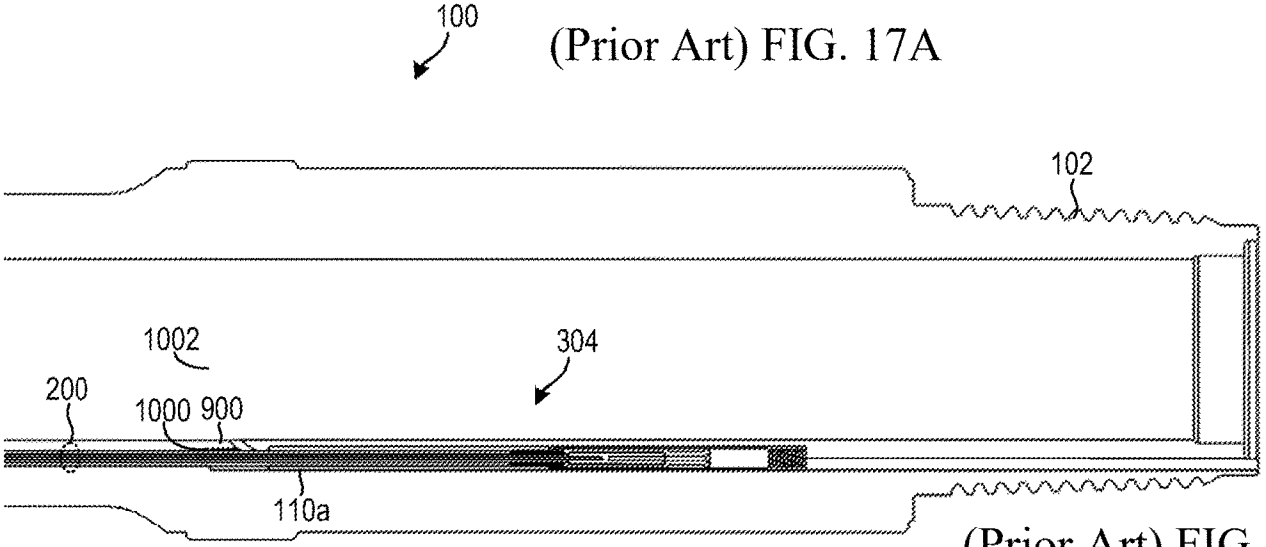
(Prior Art) FIG. 17B

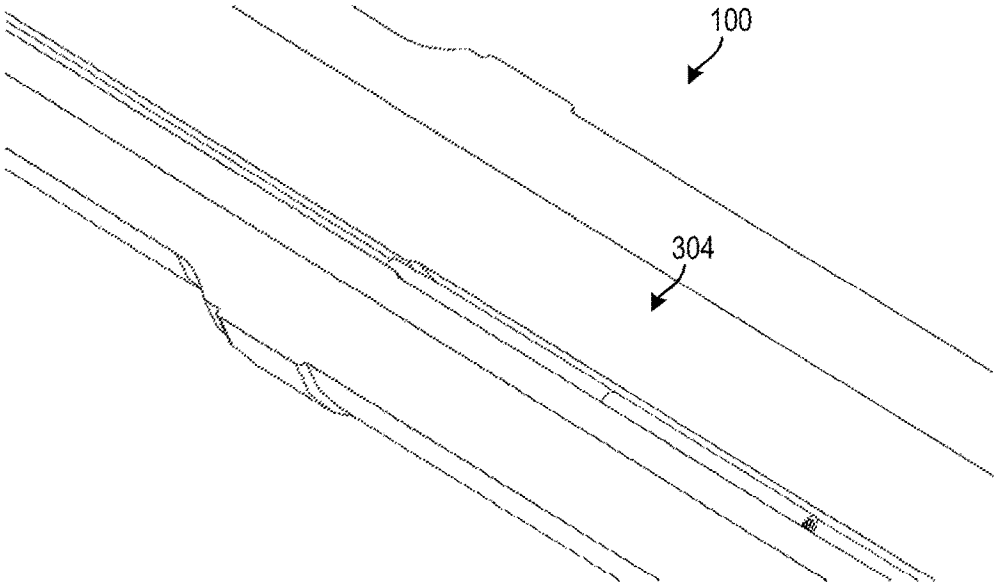
(Prior Art) FIG. 18A
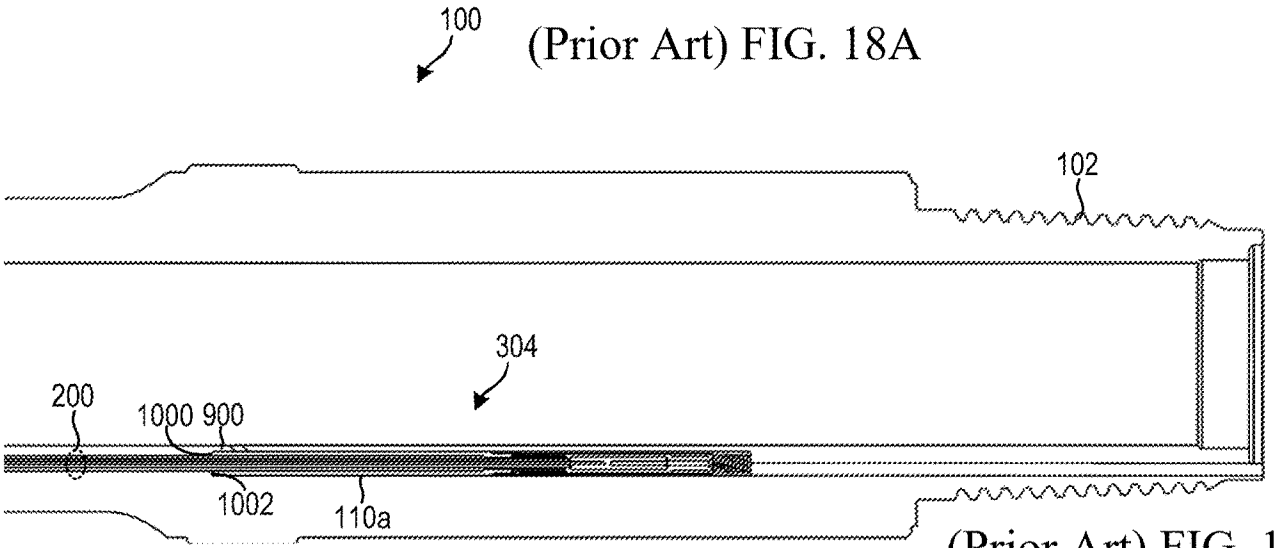
(Prior Art) FIG. 18B

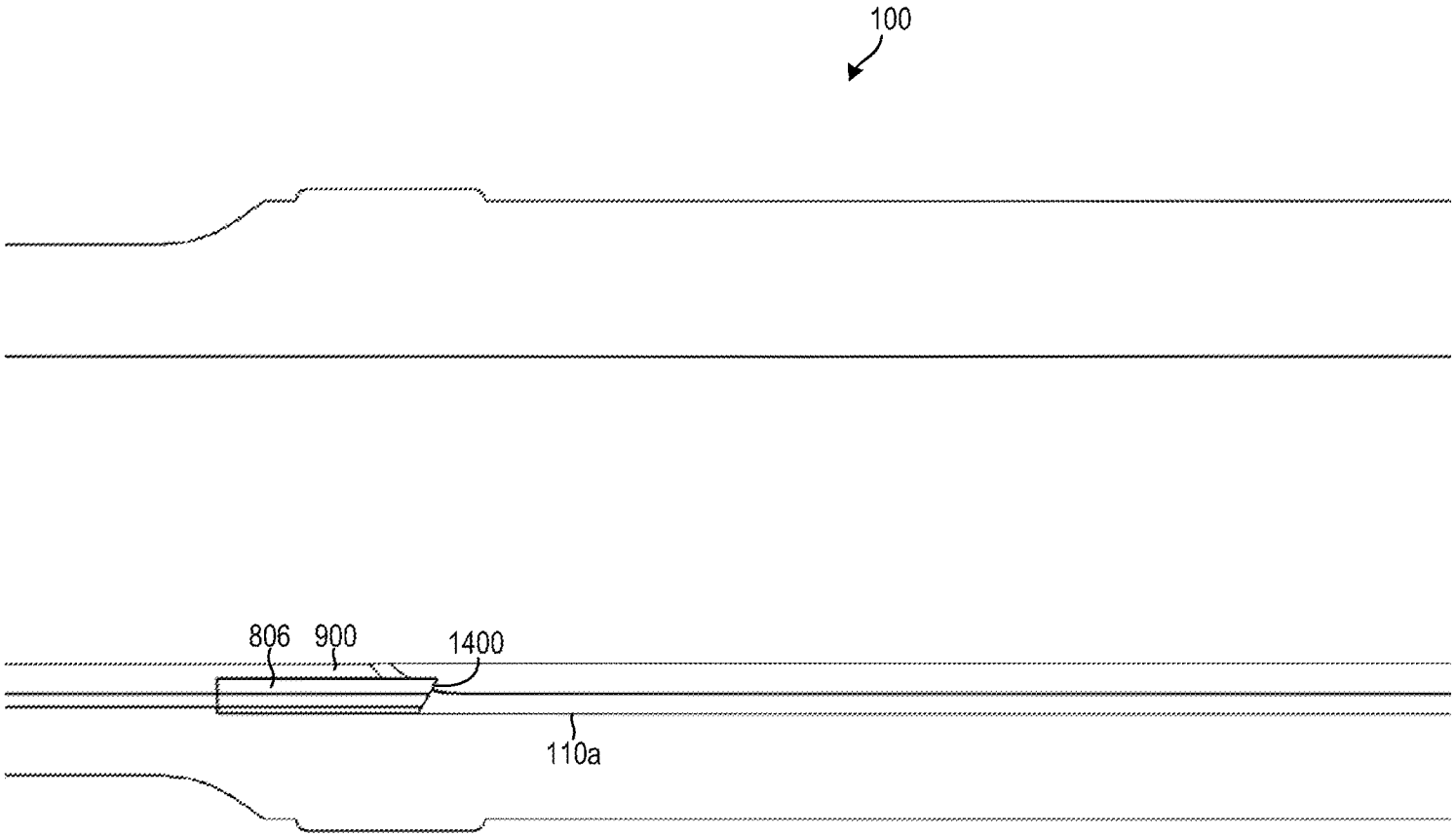
(Prior Art) FIG. 19

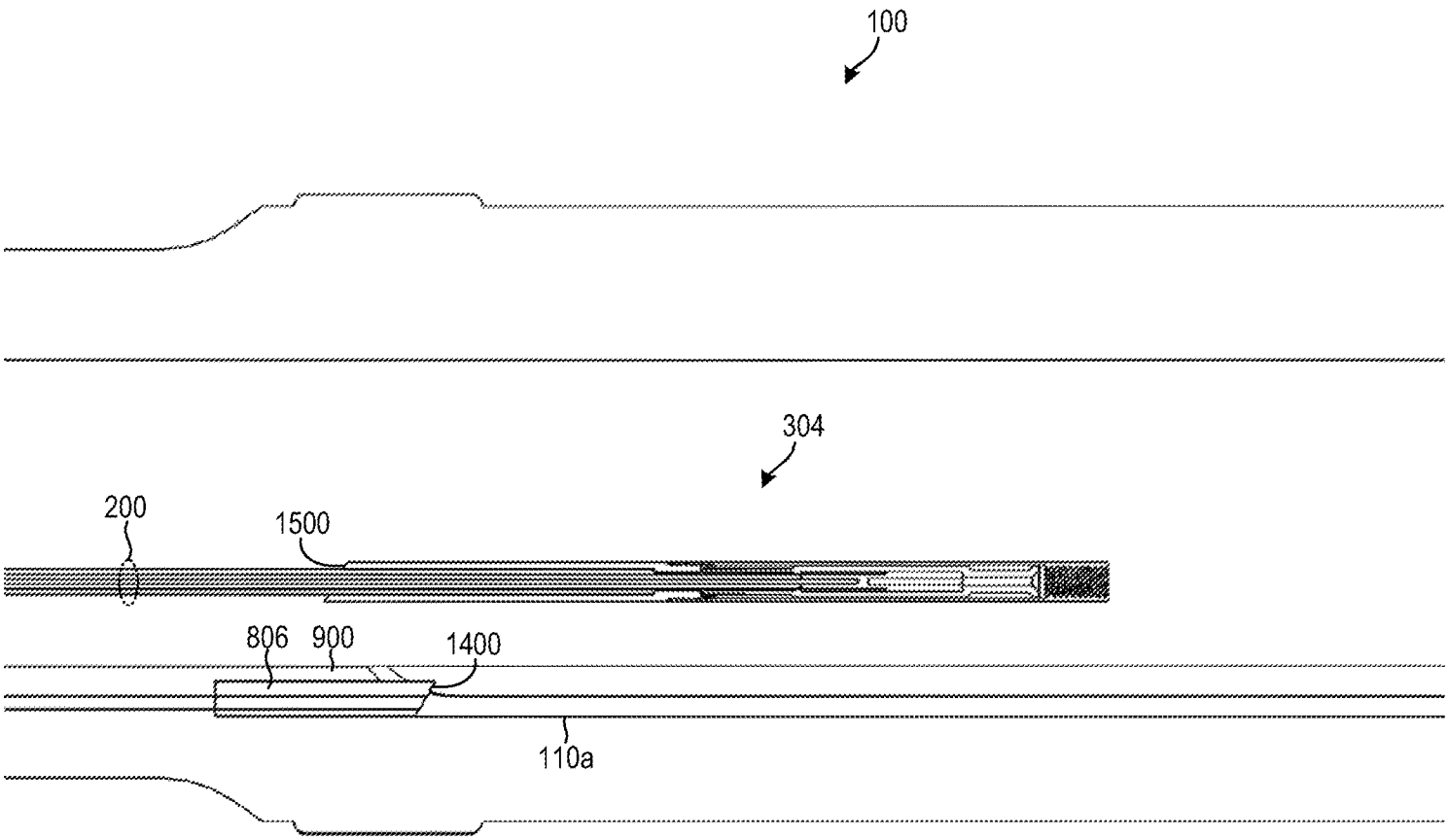
(Prior Art) FIG. 20

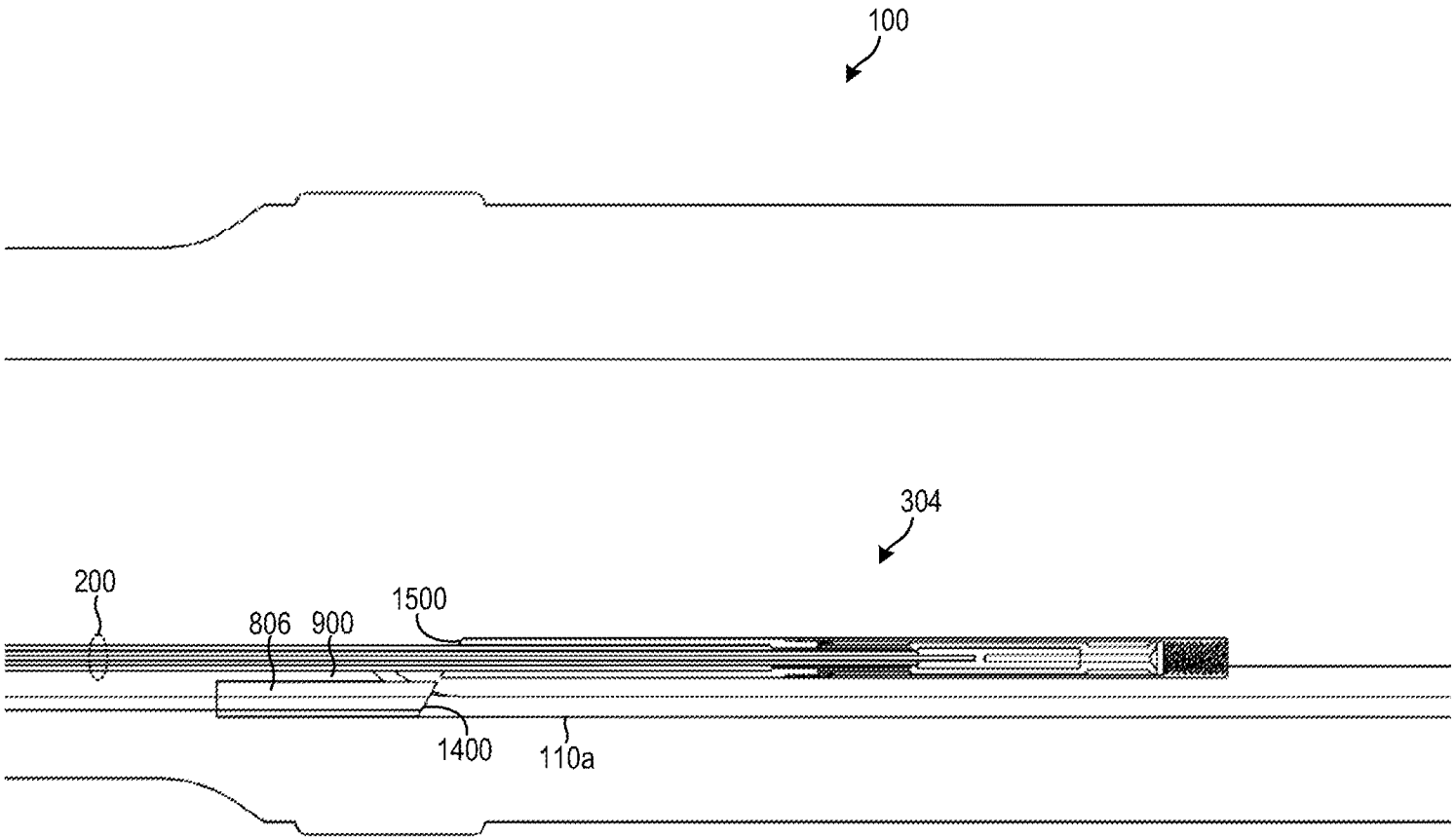
(Prior Art) FIG. 21

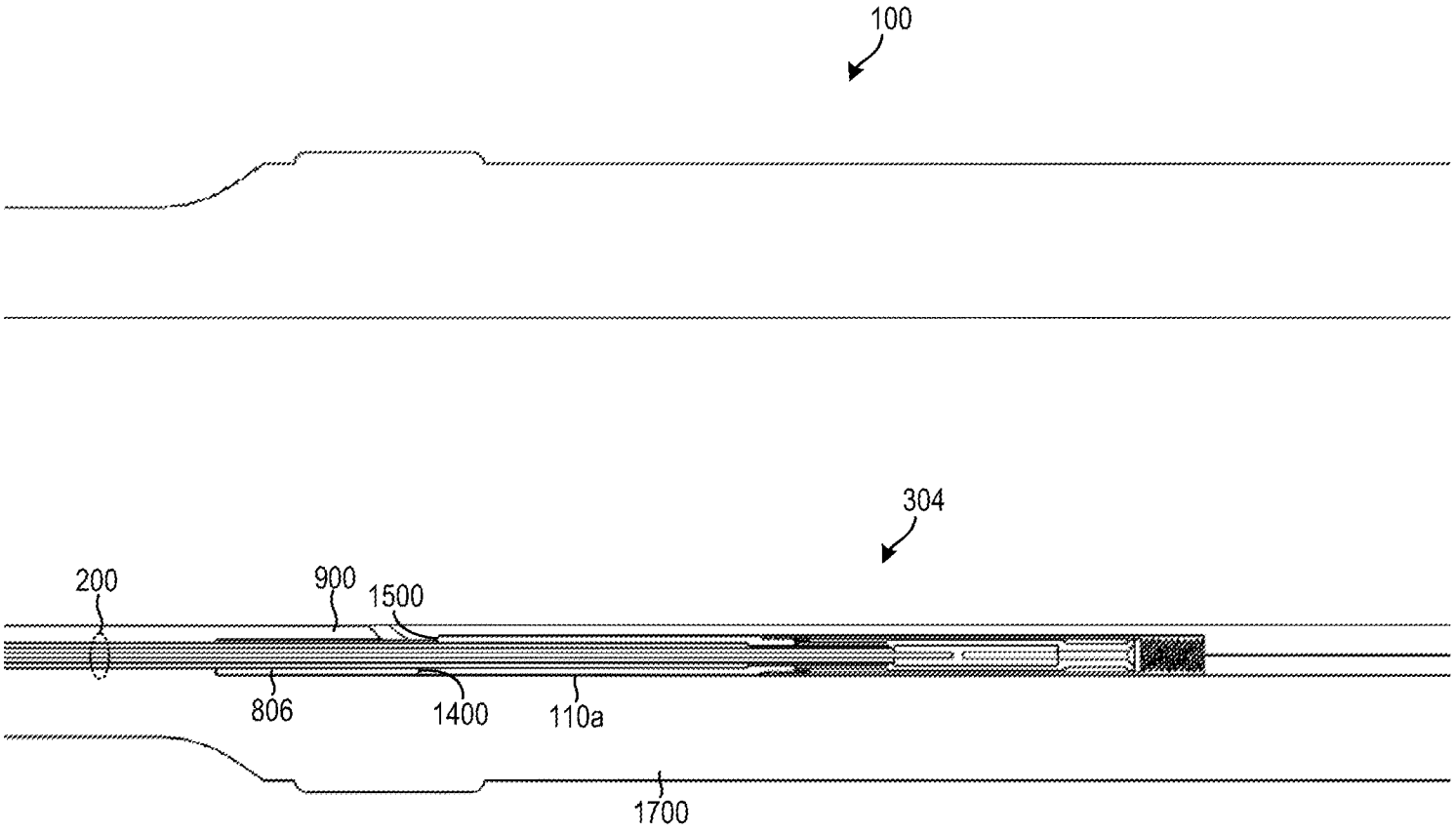
(Prior Art) FIG. 22

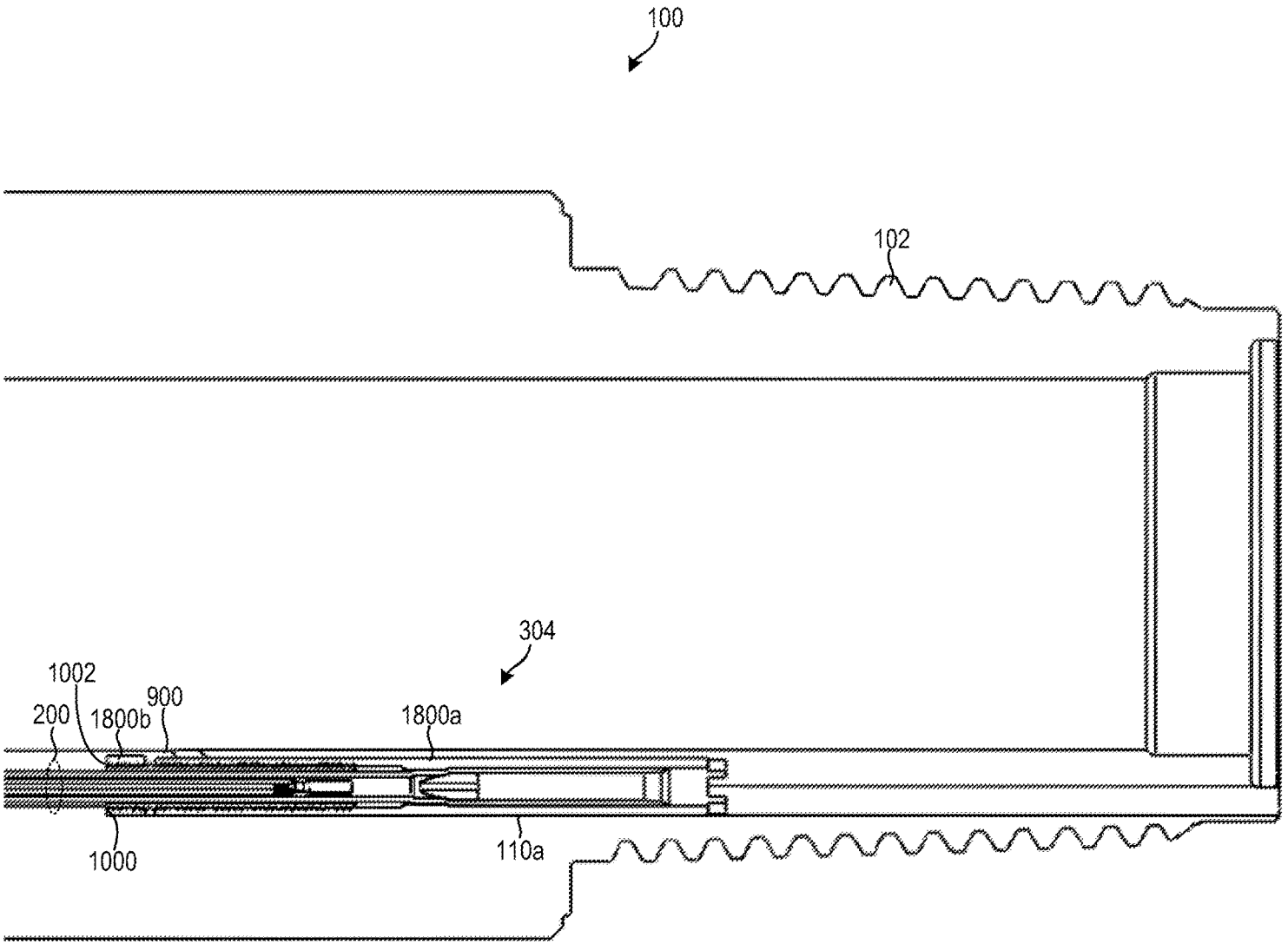
(Prior Art) FIG. 23

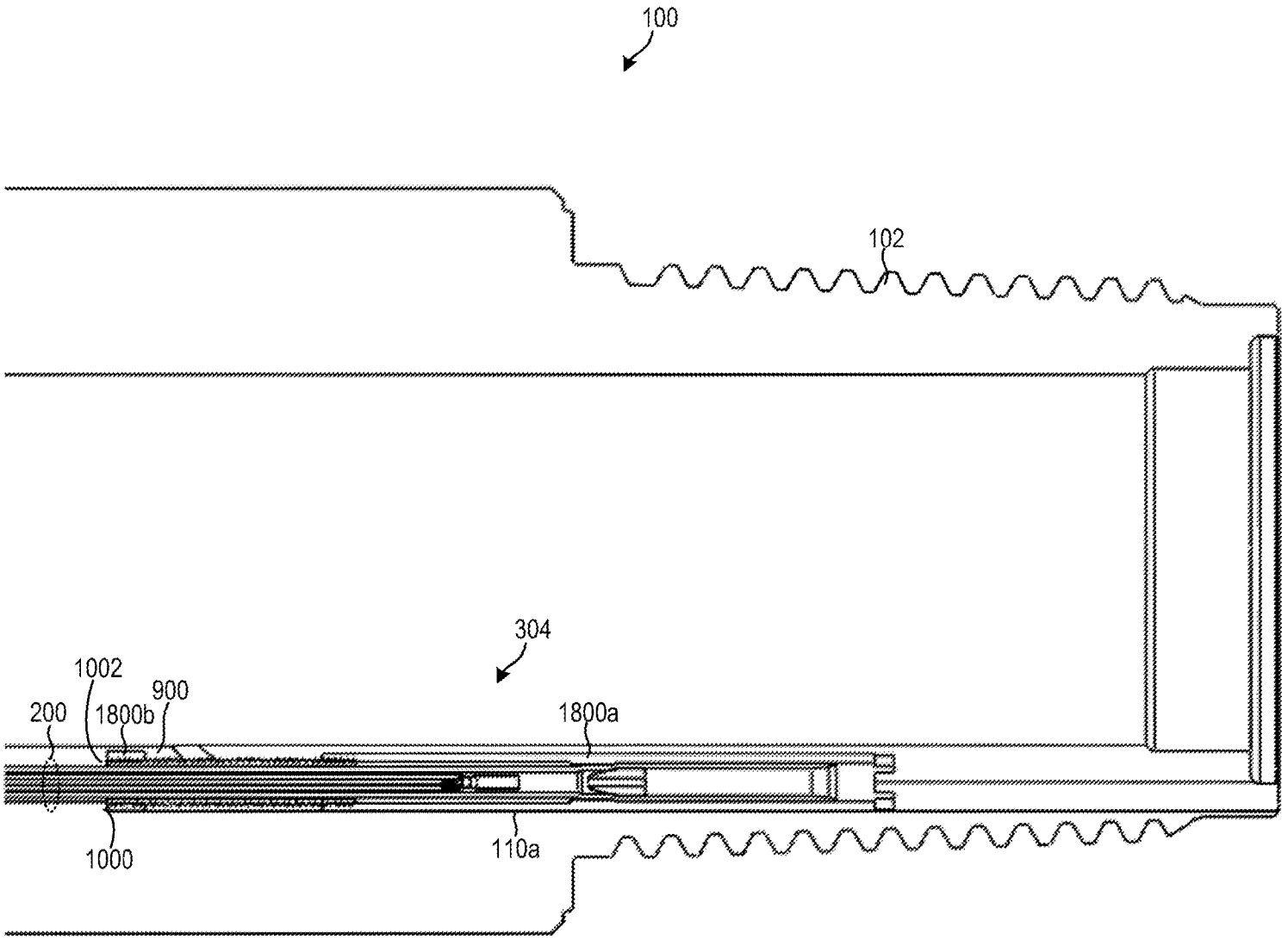
(Prior Art) FIG. 24

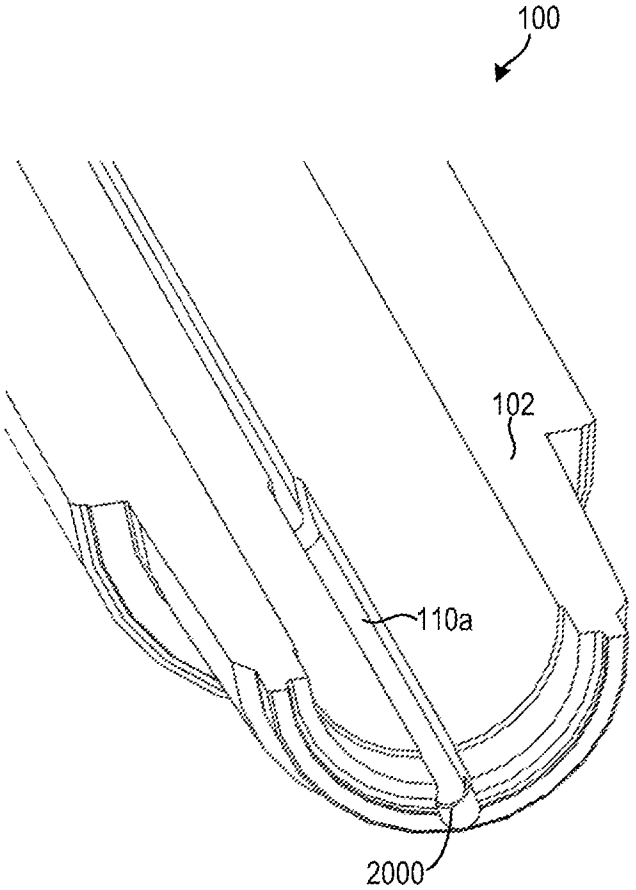
(Prior Art) FIG. 25B
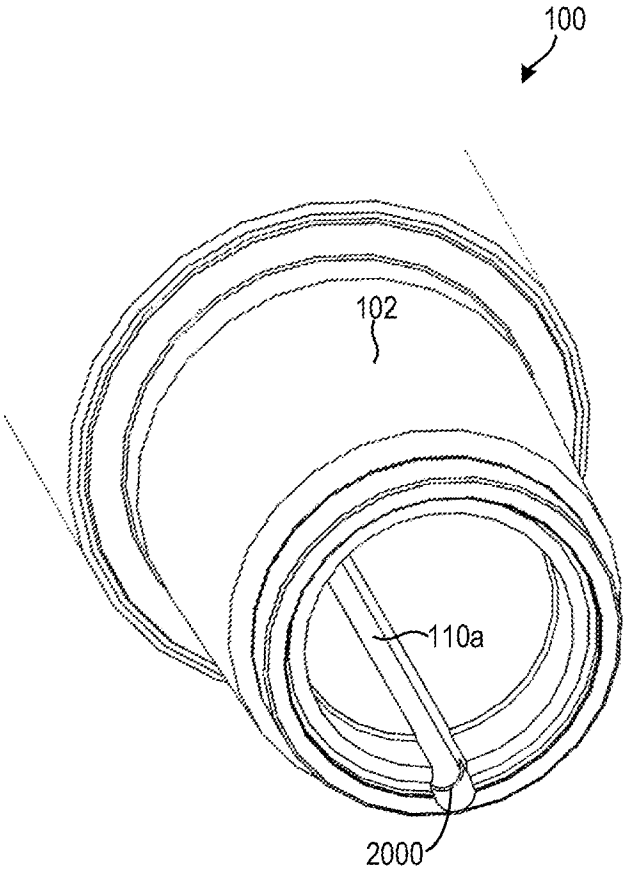
(Prior Art) FIG. 25A

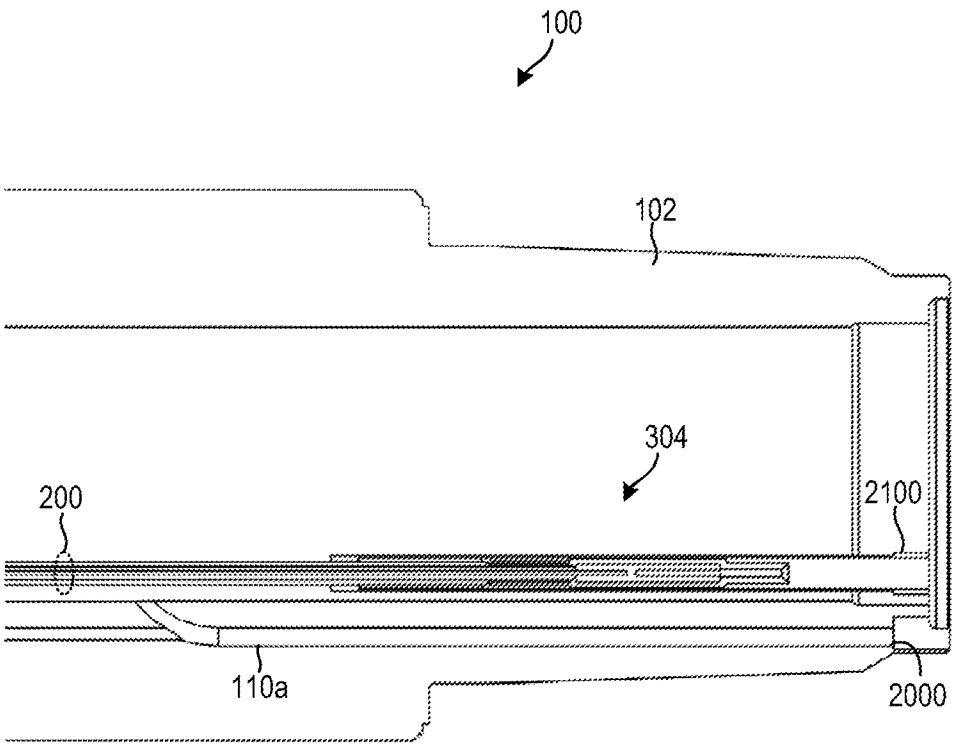
(Prior Art) FIG. 26B
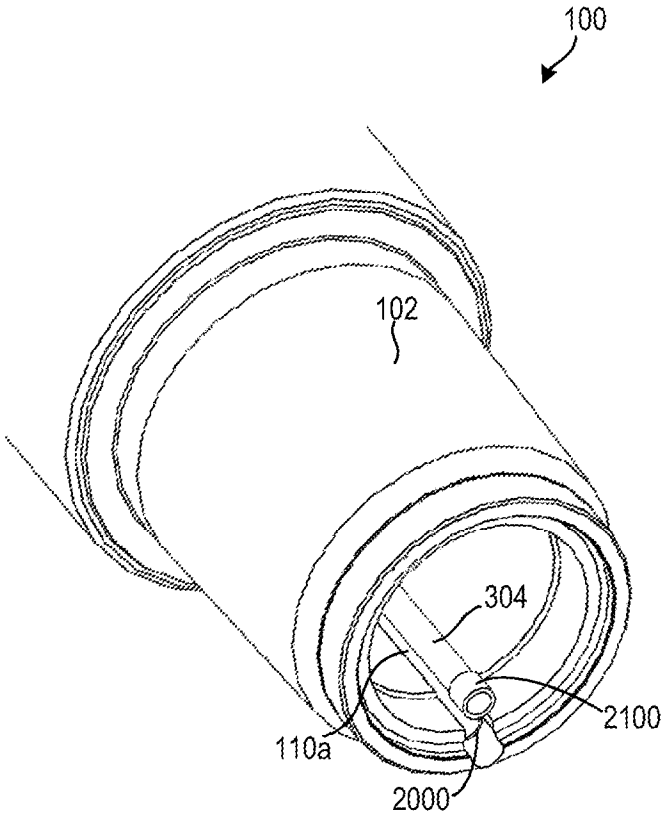
(Prior Art) FIG. 26A

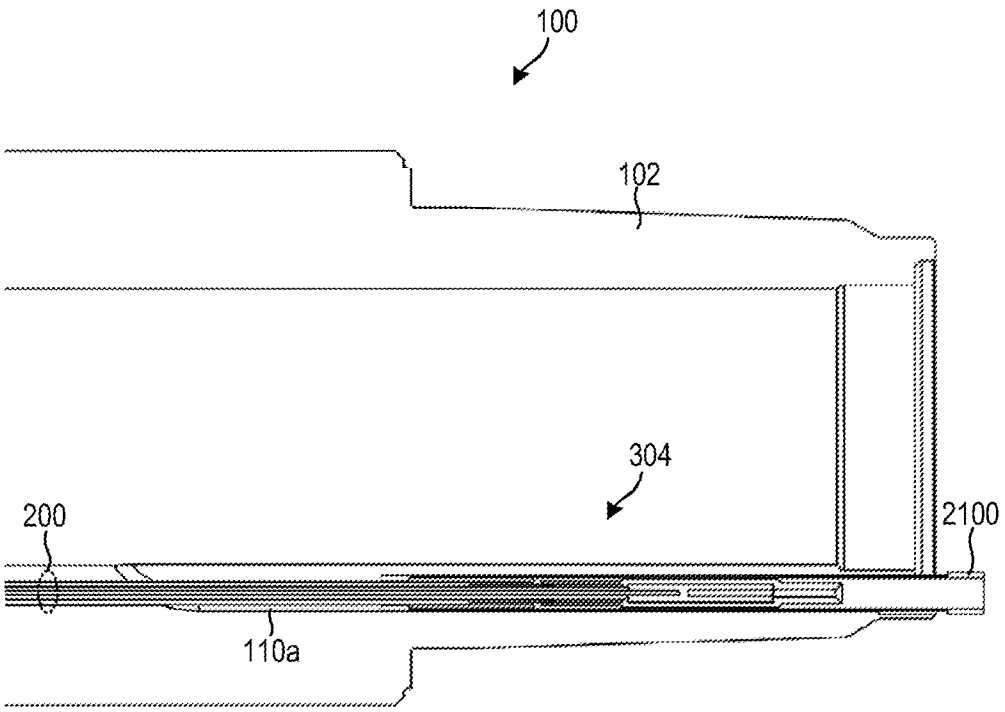
(Prior Art) FIG. 27B
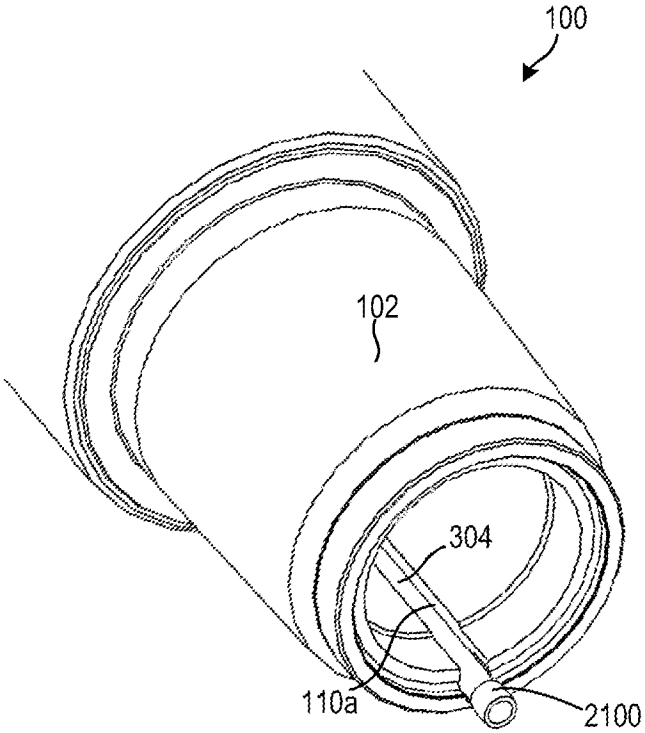
(Prior Art) FIG. 27A

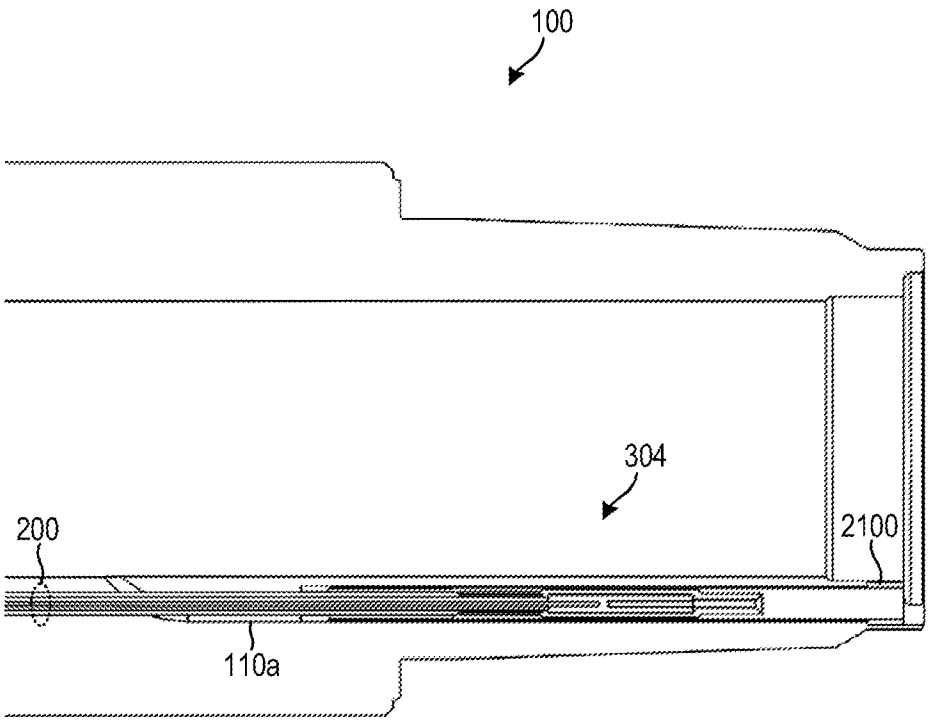
(Prior Art) FIG. 28B
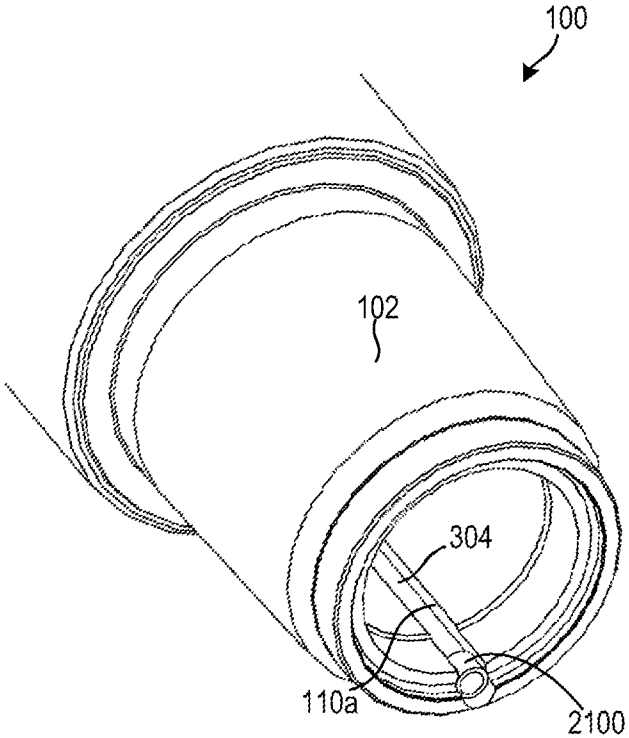
(Prior Art) FIG. 28A

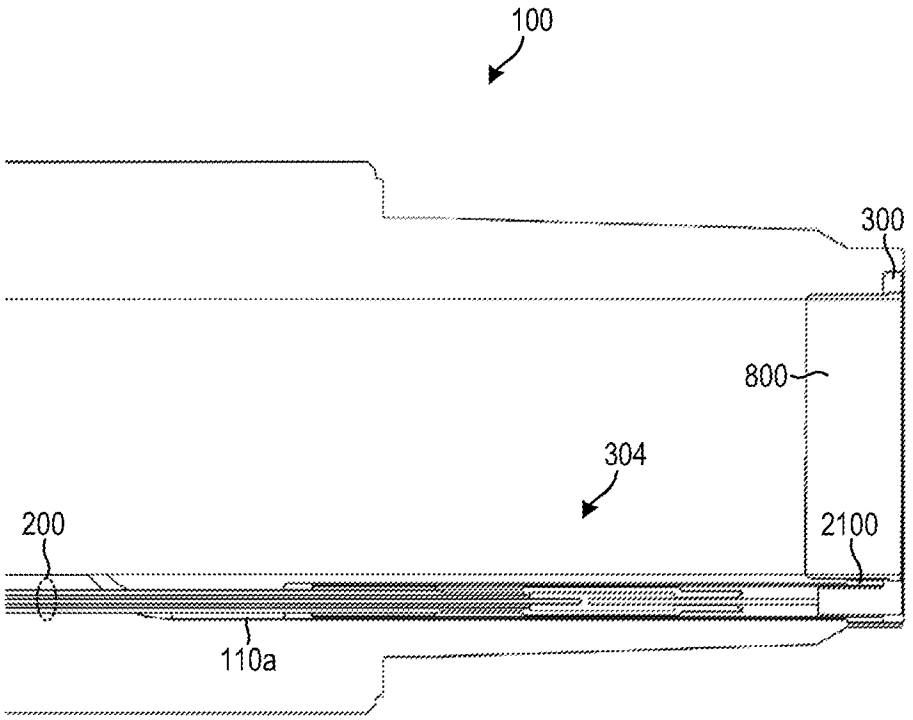
(Prior Art) FIG. 29B
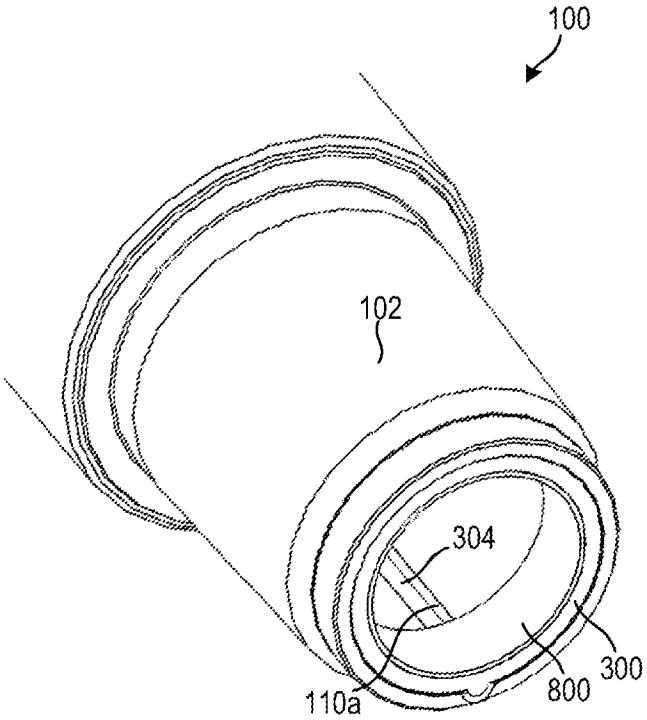
(Prior Art) FIG. 29A

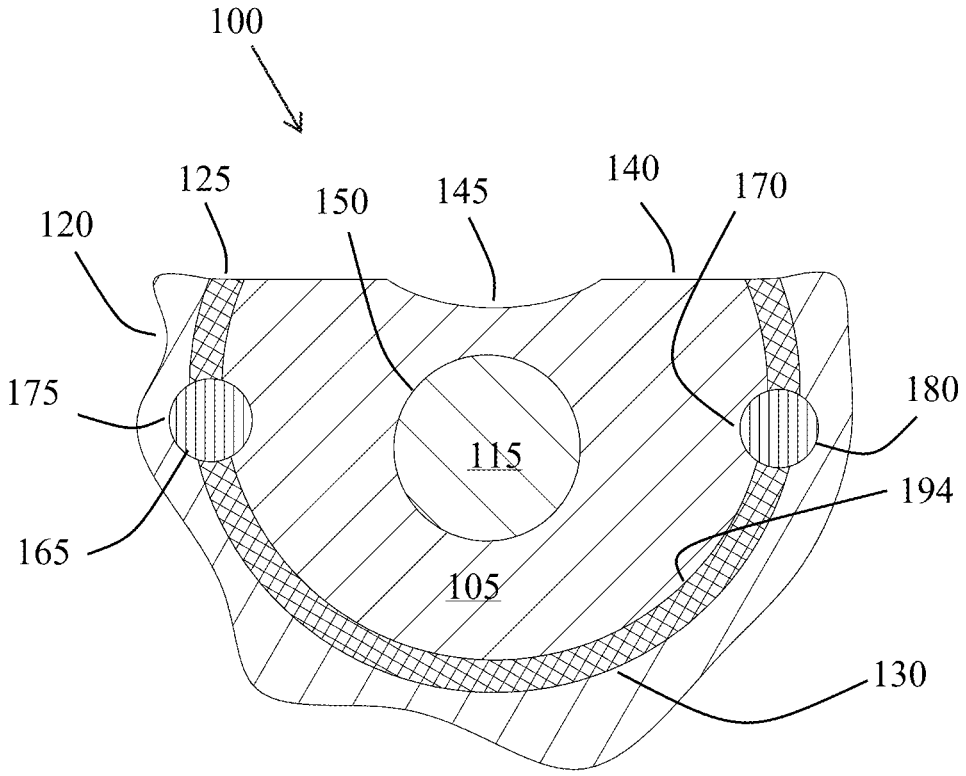
(Prior Art) FIG. 30
From U.S. Pat. App. No.
17/893,575

TRANSMISSION LINE CYLINDRICAL CONNECTOR ASSEMBLY

RELATED APPLICATIONS

The present disclosure presents a modification of pending U.S. patent application Ser. No. 17/198,356, to Meier et al., entitled TRANSMISSION LINE RETENTION SLEEVE FOR DRILL STRING COMPONENTS, filed Mar. 21, 2021, incorporated herein by this reference.

U.S. patent application Ser. No. 17/893,575, to Fox, entitled A Downhole Electromagnetic Core Assembly, filed Aug. 23, 2022, is incorporated herein by this reference.

BACKGROUND

Field of the Invention

This invention relates to apparatus and methods for transmitting data and signals along a drill string.

Background of the Invention

For at least a half century, the oil and gas industry has sought to develop downhole telemetry systems that enable high-definition formation evaluation and borehole navigation while drilling in real time. The ability to transmit large amounts of sub-surface data to the surface has the potential to significantly decrease drilling costs by enabling operators to accurately direct the drill string to hydrocarbon deposits. Such information may also improve safety and reduce the environmental impacts of drilling. This technology may also be desirable to take advantage of numerous advances in the design of tools and techniques for oil and gas exploration and may be used to provide real-time access to data such as temperature, pressure, inclination, salinity, and the like, while drilling.

In order to transmit data at high speeds along a drill string, various approaches have been attempted or suggested. One approach that is currently being implemented and achieving commercial success is to incorporate data transmission lines, or wires, into drill string components to bi-directionally transmit data along the drill string. For example, drill string components may be modified to include high-speed, high-strength data cable running through the central bores of these components. In certain cases, this approach may require placing repeaters or amplifiers at selected intervals along the drill string to amplify or boost the signal as it travels along the transmission lines.

In order to implement a "wired" drill string, apparatus and methods are needed to route transmission lines or wires, such as coaxial cable, along or through the central bore of drill string components. Ideally, such apparatus and methods would be able to hold the transmission lines under tension to minimize movement of the transmission line within the central bore as well as minimize interference with tools or debris moving therethrough. Further needed are apparatus and method to seal and isolate the transmission line from drilling fluids traveling through the central bore of the drill string. Yet further needed are apparatus and methods to quickly install the transmission lines in drill string components, while minimizing the need for expensive equipment or highly trained personnel.

SUMMARY

The present application presents modifications and alterations to the '356 reference incorporated herein. The following detailed description is related to FIGS. 1-5. The teachings of the '356 and the '575 references apply to FIGS. 1-5 in so far as such teachings are not modified by the FIGS.

A tool string electrical transmission line connector is disclosed that may comprise a cylinder adapted for mounting within a bore of a tool string component. The connector may also comprise a slit cylinder. The cylinder may be disposed on or adjacent to a shoulder within the bore. The cylinder may comprise an inside axial side wall spaced apart from an outside axial side wall, the respective side walls joining top and bottom surfaces.

The outside axial side wall may comprise an axial channel that is open to the outside axial side wall. The outside axial channel or slot may intersect the bottom surface and a housing open to the outside axial side wall and open to the top surface. An electrical transmission line connector may be disposed within the housing. An electrical transmission line may be disposed within the axial channel or slot and connected within the housing to an electrical transmission element that may be disposed in an annular groove in the top surface or to an adjacent electrical transmission element mounted above the cylinder. The electrical transmission element may be an inductive coupler as taught at (Prior Art) FIG. 8 and at (Prior Art) FIG. 30. Further, the transmission element may comprise a magnetically conductive electrically insulating, MCEI, core disposed within a mesh housing, as taught in the '575 reference.

Providing the axial channel or slot and the housing in the outside axial side wall may be preferred to forming a channel and housing in the wall of a tool string component due to the ease of manufacturer in the cylinder. Also, forming the channel and the housing in the outside side wall may reduce the risk of compromising the integrity of the tool string component at locations that may be subject to high stresses during the makeup of the tool string and operation of the tool string component downhole. Moreover, when the cylinders are fit into the tool string component, the outside side wall may be tightly sealed against the bore wall of the component, thereby protecting the components within the channel and the housing from damages during tool string make up and downhole operations. A transmission line anchor may be disposed within the housing as taught in the '375 reference.

The axial channel and housing may further comprise one or more tab closures along the outside surface of the channel and housing. The tab closures may be formed such that when the cylinder may be fitted into the tool string component, the tab closures close over the channel and housing thereby securing the transmission line within the channel and housing. The one or more tab closures may comprise a clamp. When the tab closes over the channel and housing, the clamp may provide additional security for the components within the channel and housing. The clamp may comprise a protrusion formed in the inside surface of the tab. The clamp may comprise polymer suitable for downhole conditions that may elastically deform around the components within the channel and housing. Moreover, the axial channel and housing may comprise an electrical insulating filler to further protect the components within the channel and housing.

The cylinder may be mounted within the bore using a press fit or a spring fit, respectively. The nature of the fit may depend on the downhole components and the anticipated uses for the components. For example, a tighter press fit may be desired when the cylinder may be designed to fit into the bore of a drill pipe adjacent the threaded tool joints. These applications are likely to experience higher stresses than say an electrical application within the bore of a component installed into the bottom hole assembly.

The cylinder may further comprise a modified outside axial side wall. The modified outside wall surface may comprise discontinuities. The discontinuities may be formed by shot peening, laser peening, brinelling, hatching, plating, or by electrical or chemical ablation. Also, the side wall may comprise hard particles such as diamond, carbide, and sand to further secure the cylinder in the bore of the component. Further, the outside axial side wall may comprise a hardness greater than the hardness of the bore. Or the outside axial side wall may comprise a hardness less than the hardness of the bore.

The tool string electrical transmission line connector may be sealed against contamination by gaskets. The axial channel may further comprise a gasket intersecting the bottom surface. This gasket may prevent the introduction of gases and fluids into the channel and housing. A gasket may be disposed within the housing where the housing intersects the top surface. An internal gasket may be positioned between the channel and the housing.

The following portion of the summary is taken from the '356 reference and applies to the FIGS. 1-5 except as modified by said FIGS.

The invention has been developed in response to the present state of the art and, in particular, in response to the problems and needs in the art that have not yet been fully solved by currently available apparatus and methods. Accordingly, embodiments of the invention have been developed to effectively retain transmission lines within drill string components. The features and advantages of the invention will become more fully apparent from the following description and appended claims or may be learned by practice of the invention as set forth hereinafter.

Consistent with the foregoing, an apparatus for retaining a transmission line within a drill string component is disclosed. In one embodiment, such an apparatus includes a drill string component comprising a bore having an internal diameter. A slot is formed in the internal diameter to receive a transmission line. A first feature within the slot is configured to engage a corresponding second feature on the transmission line and thereby retain an end of the transmission line. A sleeve is inserted into the internal diameter to keep the transmission line within the slot.

In another aspect of the invention, a system for retaining a transmission line within a drill string component is disclosed. In one embodiment, such a system includes a drill string that comprises a drill string component. The drill string component has a bore having an internal diameter. A slot is formed in the internal diameter to receive a transmission line. A first feature within the slot is configured to engage a corresponding second feature on the transmission line and thereby retain an end of the transmission line. A sleeve is inserted into the internal diameter to keep the transmission line within the slot.

In another aspect of the invention, an apparatus for retaining a transmission line within a drill string component includes a drill string component comprising a bore having an internal diameter. A slot is formed in the internal diameter to receive a transmission line. A first feature within the slot is configured to engage a corresponding second feature on the transmission line and thereby retain an end of the transmission line. The first feature comprises a first angled surface configured to contact and engage a corresponding second angled surface of the second feature. The first and second angled surfaces are oriented such to keep the transmission line retained within the slot when tension is placed on the transmission line.

In another aspect of the invention, a system for retaining a transmission line within a drill string component includes a drill string comprising a drill string component. The drill string component has a bore having an internal diameter. A slot is formed in the internal diameter to receive a transmission line. A first feature within the slot is configured to engage a corresponding second feature on the transmission line and thereby retain an end of the transmission line. The first feature comprises a first angled surface configured to contact and engage a corresponding second angled surface of the second feature. The first and second angled surfaces are oriented such to keep the transmission line retained within the slot when tension is placed on the transmission line.

In another aspect of the invention, an apparatus for retaining a transmission line within a drill string component includes a drill string component comprising a bore having an internal diameter. A slot is formed in the internal diameter to receive a transmission line. A shoulder within the slot is configured to engage a tension anchor attached to the transmission line. The tension anchor is configured to hold tension in the transmission line. The tension anchor includes a first component that is attached to the transmission line, and a second component that is threaded onto the first component. In certain embodiments, the second component contains a connector configured to enable connection to the transmission line.

In another aspect of the invention, a system for retaining a transmission line within a drill string component includes a drill string comprising a drill string component. The drill string component has a bore having an internal diameter. A slot is formed in the internal diameter to receive a transmission line. A shoulder within the slot is configured to engage a tension anchor attached to the transmission line. The tension anchor is configured to hold tension in the transmission line. The tension anchor includes a first component that is attached to the transmission line, and a second component that is threaded onto the first component. In certain embodiments, the second component contains a connector configured to enable connection to the transmission line.

BRIEF DESCRIPTION OF THE DRAWINGS

In order that the advantages of the invention will be readily understood, a more particular description of the invention briefly described above will be rendered by reference to specific embodiments illustrated in the appended drawings. Understanding that these drawings depict only typical embodiments of the invention and are not therefore to be considered limiting of its scope, the invention will be described and explained with additional specificity and detail through use of the accompanying drawings, in which:

(PRIOR ART) FIG. 6 is a cross-sectional view showing a drill string component with a slot in each end configured to retain a transmission line.

(PRIOR ART) FIG. 7 is a cross-sectional view showing the drill string component of (PRIOR ART) FIG. 6 with the transmission line installed.

(PRIOR ART) FIG. 8 is an enlarged cross-sectional view showing the pin end of the drill string component.

(PRIOR ART) FIG. 9 is an enlarged cross-sectional view showing the pin end and associated slot of the drill string component.

(PRIOR ART) FIG. 10 is a high-level block diagram showing various design choices for installing a transmission line in a drill string component.

(PRIOR ART) FIG. 11A is a cross-sectional view showing a tension anchor held to the transmission line using a flare.

(PRIOR ART) FIG. 11B is a cross-sectional view showing a tension anchor threaded onto the transmission line.

(PRIOR ART) FIG. 12A is a cross-sectional view showing a tension anchor crimped onto the transmission line.

(PRIOR ART) FIG. 12B is a cross-sectional view showing a tension anchor crimped and threaded onto the transmission line.

(PRIOR ART) FIG. 13 is an exploded view showing one embodiment of a transmission line retention system in accordance with the invention.

(PRIOR ART) FIG. 14 is a cross-sectional view showing one embodiment of a drill string component with the transmission line and transmission element installed.

(PRIOR ART) FIGS. 15A through 18B show one embodiment of a transmission line retention system within a drill string component, and a method for installing the transmission line in the drill string component.

(PRIOR ART) FIGS. 19 through 22 show another embodiment of a transmission line retention system within a drill string component, and a method for installing the transmission line in the drill string component.

(PRIOR ART) FIGS. 23 and 24 show another embodiment of a transmission line retention system within a drill string component, and a method for installing the transmission line in the drill string component.

(PRIOR ART) FIGS. 25A through 29B show another embodiment of a transmission line retention system within a drill string component, and a method for installing the transmission line in the drill string component.

(PRIOR ART) FIG. 30 is a diagram of an inductive coupler taken from the '575 reference at FIG. 4 of said reference.

DETAILED DESCRIPTION

Figure 1:
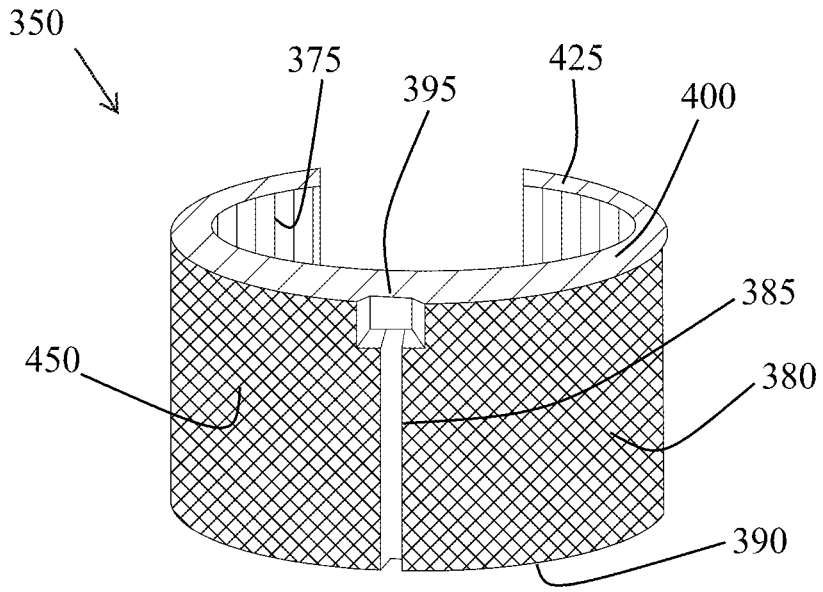
FIG. 1 is a diagram of a slit cylinder of the present invention.
Figure 2:
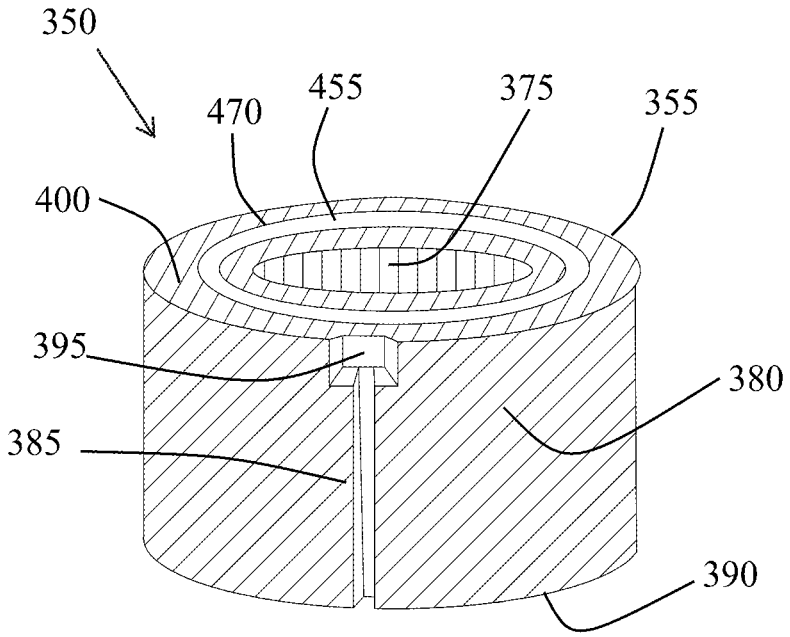
FIG. 2 is a diagram of a cylinder comprising an inductive coupler.
Figure 3:
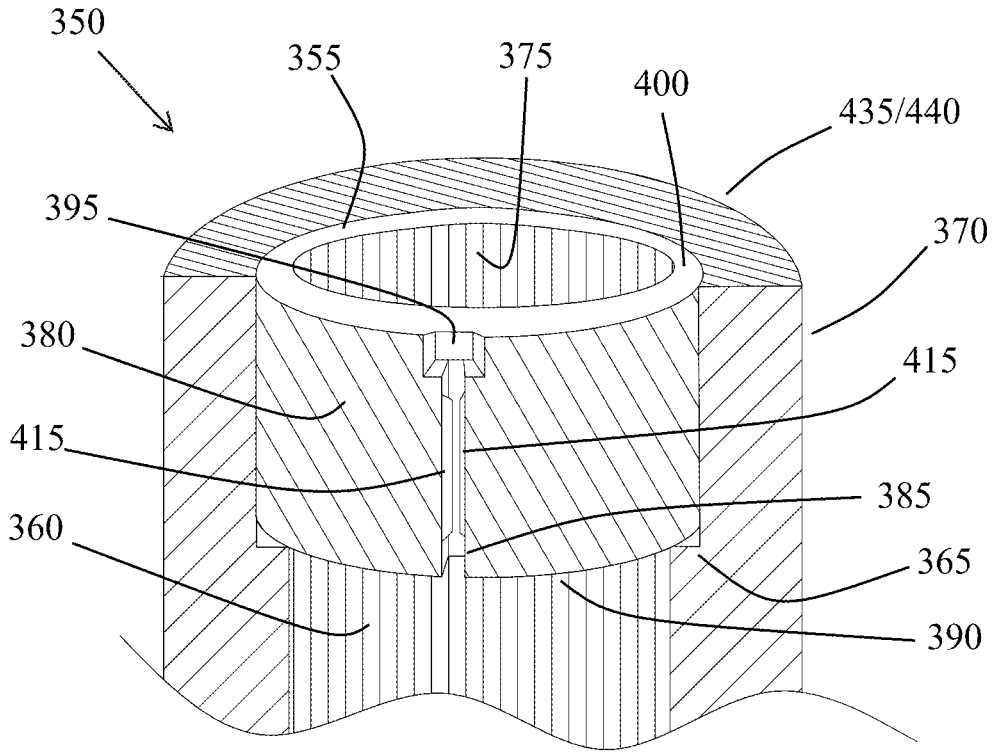
FIG. 3 is a diagram of a cylinder fit into a bore of a downhole tool.
Figure 4:
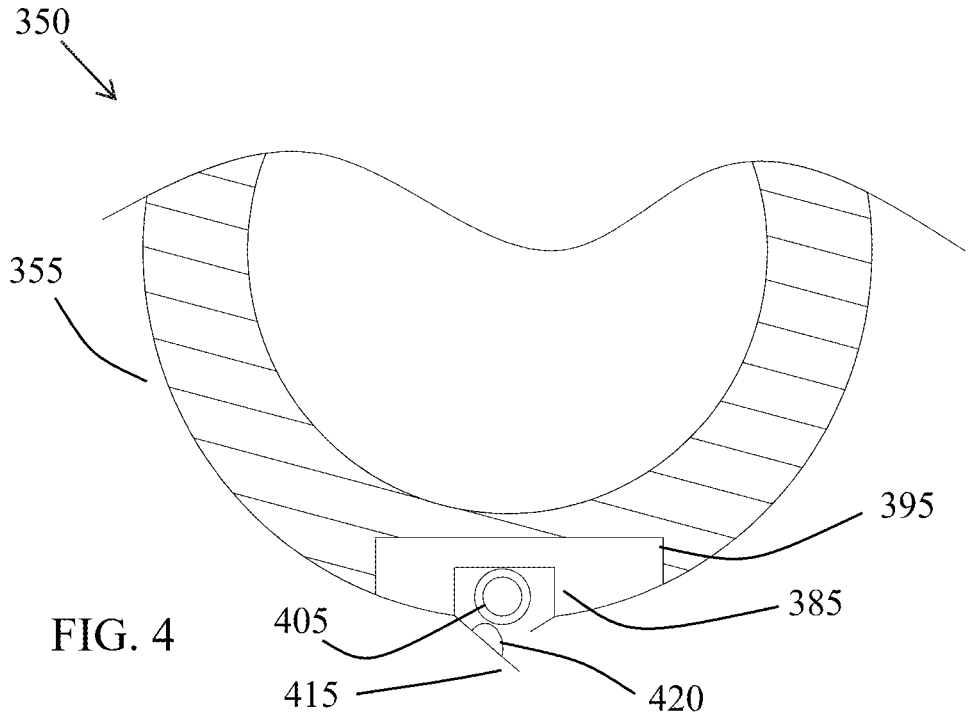
FIG. 4 is a partial diagram plan view of a cylinder of the present invention.
Figure 5:
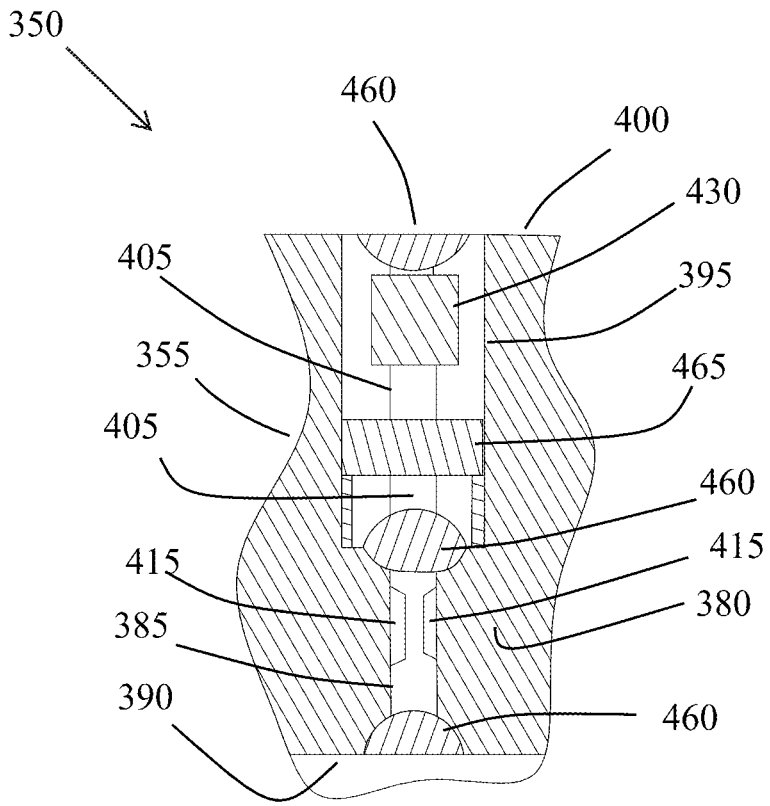
FIG. 5 is a diagram of an axial channel and housing of the present invention.

The present application presents modifications and alterations to the '356 reference incorporated herein. The following detailed description is related to FIGS. 1-5. The teachings of the '356 and the '575 references apply to FIGS. 1-5 in so far as such teachings are not modified by the FIGS.

A tool string electrical transmission line connector 350 is disclosed that may comprise a cylinder 355 adapted for mounting within a bore 360 of a tool string component 370. The connector 350 may also comprise a slit cylinder 425. The cylinder 355/425 may be disposed on or adjacent to a shoulder 365 within the bore 360. The cylinder 355/425 may comprise an inside axial side wall 375 spaced apart from an outside axial side wall 380, the respective side walls joining top 385 and bottom 390 surfaces.

The outside axial side wall 380 may comprise an axial channel 385 that is open to the outside axial side wall 380. The outside axial channel may intersect the bottom surface 390 and a housing 395 open to the outside axial side wall 380 and open to the top surface 400. An electrical transmission line connector 430 may be disposed within the housing 395. An electrical transmission line 405 may be disposed within the axial channel 385 and connected within the housing 395 to an electrical transmission element 455 that may be disposed in an annular groove 470 in the top surface 400 or to an adjacent electrical transmission element 410 mounted above the cylinder. The electrical transmission element 410 may be an inductive coupler as taught at (Prior Art) FIG. 8 and at (Prior Art) FIG. 30. Further, the transmission element 410 may comprises a magnetically conductive electrically insulating, MCEI, core disposed within a mesh housing, as taught in the '575 reference.

Providing the axial channel 385 and the housing 395 in the outside axial side wall 380 may be preferred to forming a channel and housing in the wall of a tool string component 370 due to the ease of manufacturer in the cylinder 355/425. Also, forming the channel 385 and the housing 395 in the outside side wall 380 may reduce the risk of compromising the integrity of the tool string component 370 at locations that may be subject to high stresses during the makeup of the tool string and operation of the tool string component 370 downhole. Moreover, when the cylinders 355/425 are fit into the tool string component 370, the outside side wall 380 may be tightly sealed against the bore wall 360 of the component 370, thereby protecting the components within the channel 385 and the housing 395 from damages during tool string make up and downhole operations. A transmission line anchor 465 may be disposed within the housing 395 as taught in the '375 reference.

The axial channel 385 and housing 395 may further comprise one or more tab closures 415 along the outside surface of the channel 385 and housing 395. The tab closures 415 may be formed such that when the cylinder 355/425 may be fitted into the tool string component, the tab closures 415 close over the channel 385 and housing 395 thereby securing the transmission line 405 within the channel 385 and housing 395. The one or more tab closures 415 may comprise a clamp 420. When the tab 415 closes over the channel and housing, the clamp may provide additional security for the components within the channel 385 and housing 395. The clamp 420 may comprise a protrusion formed in the inside surface of the tab 415. The clamp 415 may comprise polymer suitable for downhole conditions that may elastically deform around the components within the channel and housing. Moreover, the axial channel 385 and housing 395 may comprise an electrical insulating filler to further protect the components within the channel and housing.

The cylinder 355/425 may be mounted within the bore 360 using a press fit or a spring fit, respectively. The nature of the fit may depend on the downhole components and the anticipated uses for the components. For example, a tighter press fit may be desired when the cylinder may be designed to fit into the bore 360 of a drill pipe adjacent the threaded tool joints 440. These applications are likely to experience higher stresses than say an electrical application within the bore 360 of a component 440 installed into the bottom hole assembly 455.

The cylinder 355/425 may further comprises a modified outside axial side wall 380. The modified outside wall surface may comprise discontinuities 450. The discontinuities 450 may be formed by shot peening, laser peening, brinelling, hatching, plating, or by electrical or chemical ablation. Also, the side wall may comprise hard particles such as diamond, carbide, and sand to further secure the cylinder in the bore of the component. Further, the outside axial side wall 380 may comprise a hardness greater than the hardness of the bore 360. Or the outside axial side wall 380 may comprise a hardness less than the hardness of the bore 360.

The tool string electrical transmission line connector may be sealed against contamination by gaskets. The axial channel 385 may further comprise a gasket 460 intersecting the bottom surface 390. This gasket 460 may prevent the introduction of gases and fluids into the channel 385 and housing 395. A gasket 460 may be disposed within the housing 395 where the housing intersects the top surface 400. An internal gasket may be positioned between the channel 385 and the housing 395.

The following portion of the detailed description is taken from the '356 reference and applies to FIGS. 1-5 except as modified by said FIGS.

It will be readily understood that the components of the present invention, as generally described and illustrated in the Figures herein, could be arranged and designed in a wide variety of different configurations. Thus, the following more detailed description of embodiments of apparatus and methods of the present invention, as represented in the Figures, is not intended to limit the scope of the invention, as claimed, but is merely representative of various selected embodiments of the invention.

The illustrated embodiments of the invention will be best understood by reference to the drawings, wherein like parts are designated by like numerals throughout. Those of ordinary skill in the art will, of course, appreciate that various modifications to the apparatus and methods described herein may be easily made without departing from the essential characteristics of the invention, as described in connection with the Figures. Thus, the following description of the Figures is intended only by way of example, and simply illustrates certain selected embodiments consistent with the invention as claimed herein.

Referring to (PRIOR ART) FIG. 6, a cross-sectional view showing one embodiment of a drill string component 100 is illustrated. As shown, the drill string component 100 includes a pin end 102 and box end 104. Between the pin end 102 and box end 104 is the body 106 of the drill string component 100. A typical length for a drill string component 100 is between twenty and ninety feet. Multiple drill string components 100 may be assembled into a drill string that can extend as long as 30,000 feet, which means that many hundreds of drill string components 100 (e.g., sections of drill pipe and downhole tools) may be assembled into a drill string. A drill string component 100 may include any number of downhole tools, including but not limited to heavyweight drill pipe, drill collar, crossovers, mud motors, directional drilling equipment, stabilizers, hole openers, sub-assemblies, under-reamers, drilling jars, drilling shock absorbers, and other specialized devices, which are all well known in the drilling industry.

Various designs may be used for the pin end 102 and box end 104 of the drill string component 100. Embodiments of the invention are useful for pin and box end designs that have a uniform or upset internal diameter 108 with the rest of the drill string component 100. As shown, slots 110*a*, 110*b* may be incorporated into the pin end 102 and box end 104 of the drill string component 100 to receive a transmission line. The transmission line may communicate signals between the pin end 102 and box end 104 of the drill string component 100, thereby enabling data to be transmitted along the drill string. In certain embodiments, the slots 110*a*, 110*b* may be open to the internal diameter 108 of the drill string component 100 to facilitate installation of the transmission line. As further shown, features 112*a*, 112*b* (e.g., shoulders, etc.) may be incorporated into the slots 110*a*, 110*b* to aid in retaining ends of the transmission line. These features 112*a*, 112*b* may be implemented in various different ways as will be discussed in more detail hereafter.

(PRIOR ART) FIG. 7 shows the drill string component 100 of (PRIOR ART) FIG. 6 with the transmission line 200 installed. As shown, the transmission line 200 is routed through the internal diameter 108 along the length of the drill string component 100. One end of the transmission line 200 is retained at or near the pin end 102 and the other end of the transmission line 200 is retained at or near the box end 104. In certain embodiments, the transmission line 200 is an armored transmission line 200, meaning that metal tubing or another robust material may surround the transmission line 200 and be used to protect internal wiring and/or insulation of the transmission line 200. Inside the armor, the transmission line 106 may include coaxial cable, electrical wires, optical fibers, or other conductors or cables capable of transmitting a signal.

One potential problem with routing a transmission line 200 through a drill string component 100 is that the transmission line 200 may interfere with tools, fluids, or debris moving through the central bore 108 of the drill string component 100. These tools, fluids, or debris have the potential to sever or damage the transmission line 200, thereby terminating or interrupting signals transmitted along the drill string. Thus, apparatus and methods are needed to route transmission lines 200 through drill string components 100 in a safe and reliable manner. Ideally, such apparatus and methods would be able to maintain tension in the transmission line 200 to minimize movement within the central bore 108 and minimize interference with tools or other debris moving therethrough. Ideally, such apparatus and methods will enable quick and inexpensive installation of transmission lines 106 in drill string components 100 without the need for expensive equipment or highly trained personnel.

(PRIOR ART) FIG. 8 is an enlarged cross-sectional view showing a pin end 102 of a drill string component 100. As shown, the pin end 102 may include a transmission element 300 installed in a groove or recess in a leading face 302 of the pin end 102 to transmit data and signals across the tool joint. A corresponding transmission element 300 may be installed in the box end 104. The transmission element 300 may communicate using any known method. For example, in certain embodiments, the transmission element 300 may use direct electrical contacts or inductive coupling to transmit data signals across the tool joint.

PRIOR ART) FIG. 9 is an enlarged cross-sectional view showing the pin end 102 of the drill string component 100 with the transmission element 300 and transmission line 200 removed. In this embodiment, the slot 110*a* and corresponding feature 112*a* are more clearly visible. In this embodiment, the feature 112*a* is a shoulder incorporated into the slot 110*a* that causes the slot 110*a* to get wider as it approaches the pin end 102. This shoulder may engage a corresponding feature 304, e.g., a tension anchor 304 as shown in (PRIOR ART) FIG. 8 coupled to or incorporated into an end of the transmission line 200. The shape, configuration, and location of the features 112*a*, 304 are provided by way of example and not limitation. Other shapes, configurations, and locations for the features 112*a*, 304 are possible and within the scope of the invention.

Referring to (PRIOR ART) FIG. 10, a high-level block diagram showing various design choices for installing a transmission line 200 in a drill string component 100 is illustrated. As shown, at a highest level, a design methodology 500 may designate where a transmission line 200 is anchored within the drill string component 100. In certain embodiments, the transmission line 200 is anchored underneath a press ring at or near the leading face 302 of the pin end 102, as will be discussed in association with (PRIOR ART) FIGS. 25A through 29B. In such embodiments, a tension anchor 304, used to place tension on the transmission line 200, may be attached to the transmission line 200 using, for example, a flare, threads, a crimp and sleeve, a crimp and threads, and/or the like. These different types of tension anchors 304 will be discussed in association with (PRIOR ART) FIGS. 11A through 12B.

In other embodiments, the transmission line 200 is anchored deeper within the drill string component 100, as will be discussed in association with (PRIOR ART) FIGS. 15A through 24. In such embodiments, a tension anchor 304 may be attached to the transmission line 200 using, for example, a flare, threads, a crimp and sleeve, a crimp and threads, and/or the like, as shown in (PRIOR ART) FIGS. 11A through 12B. Various different configurations/techniques may be used to hold tension on the transmission line 200. For example, a tension anchor 304 may be pulled onto a flat surface to place tension on the transmission line 200, as will be discussed in association with (PRIOR ART) FIGS. 15A through 18B. Alternatively, a tension anchor 304 may be pulled onto an angled surface to place tension on the transmission line 200, as will be discussed in association with (PRIOR ART) FIGS. 19 through 22. In yet other embodiments, a threaded tensioner may be used to place tension on the transmission line 200, as will be discussed in association with (PRIOR ART) FIGS. 23 and 24. The design choices shown in (PRIOR ART) FIG. 10 are provided by way of example and not limitation. Other design choices are possible and within the scope of the invention.

Referring to (PRIOR ART) FIG. 11A, one embodiment of a tension anchor 304 is illustrated. In this embodiment, the tension anchor 304 is attached to a transmission line 200 using a flare. As shown, the transmission line 200 includes an outer armor 600 (e.g., metal tubing) that protects internal wiring 602 such as coaxial cable. An end 606 of the outer armor 600 may be machined and flared with a tool to retain a sleeve 604 on the end of the transmission line 200. The sleeve 604 may be slipped over the transmission line 200 prior to flaring the end 606. The sleeve 604 may rest against a shoulder 112 within the slot 110*a* to hold tension in the transmission line 200. A connector 608 (e.g., a mill-max connector 608) may be inserted into the flared end 606 of the outer armor 600 to connect to the internal wiring 602 of the transmission line 200. A cone element 610, such as a ceramic cone element 610, may be inserted into the flared end 606 to prevent the flared portion of the outer armor 600 from collapsing and pulling through the sleeve 604. This cone element 610 may have an internal bore to enable a conductive dagger element (not shown) of a transmission element 300 to pass through the internal bore to contact and connect to the connector 608, and thereby connect to the internal wiring 602.

Referring to (PRIOR ART) FIG. 11B, another embodiment of a tension anchor 304 is illustrated. In this embodiment, the tension anchor 304 is threaded onto the transmission line 200. More specifically, the outer armor 600 of the transmission line 200 includes external threads that mate with corresponding internal threads of a sleeve 604. A connector 612, 614, such as an insulated boot connector 612, 614, may enable a conductive dagger element (not shown) of a transmission element 300 to connect to the internal wiring 602. In the illustrated embodiment, the sleeve 604 includes a shoulder 616 that mates with a corresponding shoulder 112 in the slot 110*a* to hold tension in the transmission line 200. This embodiment of the tension anchor 304 is designed for anchoring under a press ring, although the tension anchor 304 may also be designed for deeper anchoring within the drill string component 100.

Referring to (PRIOR ART) FIG. 12A, another embodiment of a tension anchor 304 is illustrated. In this embodiment, the tension anchor 304 is crimped onto the transmission line 200. An outer sleeve 604 is initially slipped over the transmission line 200. An inner sleeve 700 is then slipped over the transmission line 200 and crimped onto the outer diameter of the transmission line 200. The outer sleeve 604 may then be slid toward the end of the transmission line 200 until it contacts the inner sleeve 700. In certain embodiments, a spacer 702 may be inserted between the outer sleeve 604 and the inner sleeve 700 to adjust the placement of the outer sleeve 604 relative to the transmission line 200. The length of the spacer may be adjusted to modify the placement. A connector 612, 614, such as an insulated boot connector 612, 614, may enable a conductive dagger element (not shown) of a transmission element 300 to connect to the internal wiring 602 of the transmission line 200.

Referring to (PRIOR ART) FIG. 12B, another embodiment of a tension anchor 304 is illustrated. In this embodiment, the tension anchor 304 is crimped and threaded onto the transmission line 200. A sleeve 710 is initially slipped over the transmission line 200 and crimped onto the transmission line 200. This sleeve 710 is externally threaded on the end 712. An internally threaded second sleeve 714 is then screwed onto the sleeve 710. This second sleeve 714 may be used to cover and protect a connector 612, 614, such as an insulated boot connector 612, 614. The connector 612, 614 may enable a conductive dagger element (not shown) of a transmission element 300 to connect to the internal wiring 602 of the transmission line 200.

(PRIOR ART) FIG. 13 is an exploded view showing one embodiment of a transmission line retention system in accordance with the invention. The exploded view shown in (PRIOR ART) FIG. 13 is presented to show one example of a retention system in accordance with the invention and is not intended to be limiting.

In the illustrated embodiment, the retention system is anchored deep (i.e., below the press ring 800) in the drill string component 100. The illustrated embodiment also uses a crimped and threaded tension anchor 304 as discussed in association with (PRIOR ART) FIG. 12B. In addition, the tension anchor 304 utilizes a pair of angled surfaces that are oriented to keep the transmission line 200 retained within the slot 110*a* when tension is placed on the transmission line 200. Such an embodiment will be discussed in more detail in association with (PRIOR ART) FIGS. 19 through 22.

(PRIOR ART) FIG. 13 further shows a press ring 800 for insertion into the internal diameter 108 of the drill string component 100, and a transmission element 300 for transmitting signals across the tool joint. A conductive dagger element 804 extends from the transmission element 300 to the connector 612, 614. An insulated sheath 808 may surround the dagger element 804, and an outer protective sheath 810 (e.g., metal tubing) may surround the insulated sheath 808. Further shown are the sleeves 710, 714 as described in association with (PRIOR ART) FIG. 12B.

As shown in (PRIOR ART) FIG. 13, in certain embodiments, an end 812 of the sleeve 710 may be angled to contact a corresponding angle of an insert 806. This angled insert 806 may be placed within the slot 110*a* as will be explained in more detail in association with (PRIOR ART) FIGS. 19 through 22. The orientation of the angled surfaces may keep the transmission line 200 retained within the slot 110*a* when tension is placed on the transmission line 200.

(PRIOR ART) FIG. 14 is a cross-sectional view showing the retention system of (PRIOR ART) FIG. 13 assembled in the drill string component 100. Each of the components shown in (PRIOR ART) FIG. 13 are shown in (PRIOR ART) FIG. 14 with the same numbering. Notably, (PRIOR ART) FIG. 14 shows the angled insert 806 within the slot 110*a*. As shown in (PRIOR ART) FIG. 14, the angled insert 806 is retained within the slot 110*a* by overhanging material 900 (hereinafter referred to as an "overhang 900") over the angled insert 806. The angled insert 806 may be slid into the slot 110*a* beneath the overhang 900. The overhang 900 may be sized such that it allows the smaller diameter transmission line 200 to fit into the slot 110*a* while preventing the larger diameter angled insert 806 from exiting the slot 110*a*. A slot may be provided in the angled insert 806 to enable the transmission line 200 to be placed into the angled insert 806 as shown in (PRIOR ART) FIG. 13. As further shown in (PRIOR ART) FIG. 14, the orientation of the angles 902 of the insert 806 and sleeve 710 keep the transmission line 200 firmly retained within the slot 110*a* when tension is placed on the transmission line 200.

(PRIOR ART) FIGS. 15A through 18B show one embodiment of a transmission line retention system within a drill string component 100, and a method for installing the transmission line 200 in the drill string component 100. In this embodiment, the transmission line 200 is "anchored deep" and the transmission line retention system utilizes the crimped and threaded tension anchor 304 discussed in association with (PRIOR ART) FIG. 12B. As shown, a slot 110*a* is provided in the internal diameter 108 of the drill string component 100. This slot 110*a* includes an overhang 900 to retain the tension anchor 304 within the slot 110*a*.

As can be observed in (PRIOR ART) FIGS. 15A and 15B, (PRIOR ART) FIG. 15A is a perspective view of (PRIOR ART) FIG. 15B, the transmission line 200 and tension anchor 304 being initially provided in a relaxed state. In this state, the tension anchor 304 is not able to pass over the overhang 900 and slide into the slot 110*a* (assuming a tension anchor 304 at the other end of the transmission line 200 is already installed into the slot 110*b*).

In order to move the tension anchor 304 past the overhang 900, the transmission line 200 may be stretched (i.e., placed under tension). This stretching may be performed without breaking or permanently deforming the transmission line 200. For example, a thirty-four foot transmission line 200 (with metal outer armor 600) may be stretched on the order of an inch without breaking or permanently deforming the transmission line 200.

As can be observed in (PRIOR ART) FIGS. 16A and 16B, the transmission line 200 and tension anchor 304 may be stretched so that the rear portion 1002 of the tension anchor 304 moves beyond the overhang 900. In certain embodiments, a tool may be attached to an end 1004 of the tension anchor 304, such as by screwing the tool into the internal threads 1004 of the tension anchor 304, to stretch and place tension on the transmission line 200.

As can be observed in (PRIOR ART) FIGS. 17A and 17B, once past the overhang 900, the tension anchor 304 and transmission line 200 may be inserted into the slot 110*a*. Once in the slot 110*a*, the tension anchor 304 may be released. The tension in the transmission line 200 may then pull the tension anchor 304 into the void between the overhang 900 and the slot 110*a*, as shown in (PRIOR ART) FIGS. 18A and 18B. Because the tension anchor 304 is trapped below the overhang 900, the tension anchor 304 cannot leave the slot 110*a*, thereby securing the end of the transmission line 200.

As shown in (PRIOR ART) FIGS. 15A through 18B, in certain embodiments, the mating surfaces 1000, 1002 between the tension anchor 304 and the slot 110*a* are roughly perpendicular to the transmission line 200. This configuration is anchored deep and "pulled onto [a] flat," as set forth in (PRIOR ART) FIG. 12, since the tension anchor 304 is pulled onto a "flat" (i.e., perpendicular) surface. Because of the overhang 900, the tension anchor 304 is retained within the slot 110*a* until tension is released in the transmission line 200.

(PRIOR ART) FIGS. 19 through 22 show another embodiment of a transmission line retention system within a drill string component 100, and a method for installing the transmission line 200 in the drill string component 100. In this embodiment, the transmission line 200 is anchored deep and "pulled onto [an] angle" as set forth in (PRIOR ART) FIG. 10 of the patent application.

For example, referring to (PRIOR ART) FIG. 19, in certain embodiments, an angled insert 806 may be placed into the slot 110*a* under the overhang 900. Because the angled insert 806 is placed under the overhang 900, the angled insert 806 may be retained in the slot 110*a*. Alternatively, the angled insert 806 may be permanently attached to the internal diameter 108 of the drill string component 100 or a shape similar to the angled insert 806 may be milled into the internal diameter 108 of the drill string component 100. As shown in (PRIOR ART) FIG. 19, the angled surface 1400 may be oriented such as to keep the transmission line 200 retained within the slot 110*a* when tension is placed on the transmission line 200.

Referring to (PRIOR ART) FIG. 20, in order to anchor a transmission line 200 to the end of the drill string component 100, the tension anchor 304 of a transmission line 200 may be initially brought into proximity of the angled insert 806. Tension may then be placed on the tension anchor 304 and transmission line 200 to move an end 1500 the tension anchor 304 past the angled insert 806 (i.e., towards the end of the drill string component 100), as shown in (PRIOR ART) FIG. 21.

When the tension anchor 304 is past the angled insert 806, the tension anchor 304 may be moved into the slot 110*a* and the tension in the transmission line 200 may be released. This may enable the angled surface 1500 of the tension anchor 304 to come into contact with the angled surface 1400 of the insert 806. Due to the orientation of the angled surfaces 1400, 1500, the tension anchor 304 and transmission line 200 are pulled into the slot 110*a* (i.e., toward the wall of the drill string component 100) as tension is placed on the transmission line 200. In other words, the tension anchor 304 will be urged in the direction of the wall 1700 of the drill string component 100, thereby keeping the tension anchor 304 and transmission line 200 within the slot 110*a*.

(PRIOR ART) FIGS. 23 and 24 show another embodiment of a transmission line retention system within a drill string component 100, and a method for installing the transmission line 200 in the drill string component 100. In this embodiment, the tension anchor 304 is anchored deep and "pulled onto a flat" as discussed in association with (PRIOR ART) FIG. 10 of the disclosure. After being pulled onto the flat, the tension anchor 304 is then adjusted to increase tension in the transmission line 200.

For example, referring to (PRIOR ART) FIG. 23, a tension anchor 304 attached to a transmission line 200 may initially be inserted into the slot 110*a*. In this example, the slot 110*a* includes an overhang 900 and the mating surfaces 1000, 1002 are perpendicular to the transmission line 200. Furthermore, in this embodiment, the tension anchor 304 includes two components 1800*a*, 1800*b* that are threaded together. After placing the transmission line 200 and tension anchor 304 into the slot 110*a*, the first component 1800*a* of the tension anchor 304 may be rotated relative to the second component 1800*b* using a tool. Due to the threaded connection, this may cause the first component 1800*a* (which is attached to the end of the transmission line 200) to move towards the pin end 102 of the drill string component 100, thereby adding tension to the transmission line 200. This rotation may continue until a desired amount of tension is placed on the transmission line 200, as shown in (PRIOR ART) FIG. 24. To release tension in the transmission line 200, the first component 1800*a* may be rotated in the opposite direction relative to the second component 1800*b*.

(PRIOR ART) FIGS. 25A through 29B show another embodiment of a transmission line retention system within a drill string component 100, and a method for installing the transmission line 200 in the drill string component 100. In this embodiment, the tension anchor 304 is anchored beneath a press ring 800 installed in the end of the drill string component 100.

Referring to (PRIOR ART) FIGS. 25A and 25B, as shown, in certain embodiments, a shoulder 2000 may be incorporated into a slot 110*a* in the drill string component 100. In certain embodiments, this shoulder 2000 may be located at or near the end of the drill string component 100.

Referring to (PRIOR ART) FIGS. 26A and 26B, a tension anchor 304 and associated transmission line 200 may then be placed in the slot 110*a*. A shoulder 2100 on the tension anchor 304 604 may be aligned with the corresponding shoulder 2000 in the slot 110*a*. In certain embodiments, tension may be placed on the tension anchor 304 and transmission line 200 to align the shoulders 2000, 2100.

Referring to (PRIOR ART) FIGS. 27A and 27B, once the shoulder 2100 of the tension anchor 304 is aligned with the shoulder 2000 of the slot 110*a*, the tension anchor 304 and transmission line 200 may be placed in the slot 110*a*. Tension in the transmission line 200 may then be released to allow the shoulder 2100 of the tension anchor 304 to seat against the shoulder 2000 of the slot 110*a*, as shown in (PRIOR ART) FIGS. 28A and 28B. Once the shoulder 2100 of the tension anchor 304 is seated against the shoulder 2000 of the slot 110*a*, a press ring 800 may be placed in the internal diameter 108 of the drill string component 100. This press ring 800 may keep the tension anchor 304 with the slot 110*a*, thereby ensuring tension is maintained in the transmission line 200. To release tension in the transmission line 200, the press ring 800 may be removed and the tension anchor 304 may be removed from the slot 110*a*.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

The invention claimed is:

1. A tool string electrical transmission line connector assembly, comprising a cylinder adapted for mounting onto a shoulder within an axial bore wall of a tool string component;

the cylinder comprising an inside axial side wall spaced apart from an outside axial side wall joining top and bottom surfaces;

the outside axial side wall comprising an axial channel open to the outside axial side wall intersecting the bottom surface and intersecting a housing open to the outside axial side wall and open to the top surface, the axial channel comprising opposed axial outside edges at least partially protruding over the axial channel forming opposed tab closures, the respective axial protruding outside edges bend inward over the axial channel closing the axial channel when the cylinder is mounted within the axial bore, wherein an electrical transmission line connector is disposed within the housing, and wherein an electrical transmission line is disposed within the axial channel and connected within the housing to an adjacent electrical transmission device.

2. The tool string electrical transmission line connector assembly of claim 1, further comprising the one or more opposing tab closures comprising a clamp protruding into the channel from an inside surface of the tab closures.

3. The tool string electrical transmission line connector assembly of claim 1, wherein the cylinder is mounted within the bore using a press fit.

4. The tool string electrical transmission line connector assembly of claim 1, wherein the cylinder comprises a slit cylinder mounted within the bore using a spring fit.

5. The tool string electrical transmission line connector assembly of claim 1, wherein the bore comprises a tool joint.

6. The tool string electrical transmission line connector assembly of claim 1, wherein the bore comprises a downhole tool within a bottom hole assembly.

7. The tool string electrical transmission line connector assembly of claim 1, wherein the cylinder further comprises a modified outside axial side wall comprising discontinuities.

8. The tool string electrical transmission line connector assembly of claim 7, wherein the modified outside axial side wall comprising discontinuities is made up of diamond particles.

9. The tool string electrical transmission line connector assembly of claim 1, wherein the outside axial side wall comprises a hardness greater than the hardness of the bore.

10. The tool string electrical transmission line connector assembly of claim 1, wherein the outside axial side wall comprises a hardness less than the hardness of the bore.

11. The tool string electrical transmission line connector assembly of claim 1, wherein the transmission device comprises an inductive coupler.

12. The tool string electrical transmission line connector assembly of claim 11, wherein the transmission device comprises an MCEI core disposed within a U-shaped annular open mesh housing.

13. The tool string electrical transmission line connector assembly of claim 1, wherein the housing within the outside axial side wall comprises one or more tab closures.

14. The tool string electrical transmission line connector assembly of claim 1, wherein the axial channel and housing comprise an electrical insulating filler.

15. The tool string electrical transmission line connector assembly of claim 1, wherein the axial channel further comprises a gasket intersecting the bottom surface.

16. The tool string electrical transmission line connector assembly of claim 1, wherein the housing comprises a gasket intersecting the top surface.

17. The tool string electrical transmission line connector assembly of claim 1, wherein the top surface comprises an annular groove.

18. The tool string electrical transmission line connector assembly of claim 17, wherein an inductive coupler is disposed within the annular groove.

19. The tool string electrical transmission line connector assembly of claim 1, further comprising a transmission line clamp or anchor disposed within the housing.

* * * * *